United States Patent [19]

Schollmeyer et al.

[11] Patent Number: 4,504,153

[45] Date of Patent: Mar. 12, 1985

[54] PHARMACIST-PROGRAMMABLE MEDICATION PROMPTING SYSTEM AND METHOD

[75] Inventors: Thomas A. Schollmeyer; Jeffrey C. Elsmore, both of Tempe, Ariz.

[73] Assignee: R. Dean Seeman, Apache Junction, Ariz. ; a part interest

[21] Appl. No.: 521,345

[22] Filed: Aug. 8, 1983

[51] Int. Cl.[3] ..... G04B 4/700

[52] U.S. Cl. ..... 368/10; 340/309.4; 221/2; 364/569

[58] Field of Search ..... 368/10, 107–109; 221/2, 3, 15; 340/309.15, 309.4; 364/479, 569, 705, 710

[56] References Cited

U.S. PATENT DOCUMENTS

| | | | |
|---|---|---|---|
| 4,223,801 | 9/1980 | Carlson | 221/3 |
| 4,258,354 | 3/1981 | Carmon et al. | 368/10 X |
| 4,361,408 | 11/1982 | Wirtschafier | 368/10 |

*Primary Examiner*—Vit W. Miska

*Attorney, Agent, or Firm*—Cahill, Sutton & Thomas

[57] ABSTRACT

A pharmacist-programmable medication prompting system includes a programmable prompting device that is attached to a medication container and is automatically programmed in response to inputting of a physician's prescription instructions to cause the prompting device to automatically prompt a patient to take medication at prescribed times. The programming station inputs the information in serial format to the prompting device, which stores it in an internal memory. Internal clock circuitry of the prompting device periodically accesses the memory to determine if the patient is to be prompted at the present time and, if this is the case, generates a prompting signal. In response to the prompting signal an audible prompting sound is produced. Also, a prompting light blinks until the prompting device is reset. In one embodiment of the invention, the prompting device is incorporated into a locking cap of the medication container. A locking mechanism unlocks the cap in response to the prompting signal. After removal of the cap, resetting is automatically accomplished by replacement of the cap on the container. In another embodiment of the invention, the prompting device is adhesively attached to the medication container.

35 Claims, 22 Drawing Figures

| XMIT CTR | LOAD | CLOCK/DATA | RECOV'D DATA | DONE | PRESENT STATE (t) C | B | A | NEXT STATE (t+1) c | b | a | OUTPUT |
|---|---|---|---|---|---|---|---|---|---|---|---|
| X | X | 1 | X | X | 0 | 0 | 0 | 0 | 0 | 0 | |
| X | X | 0 | X | X | 0 | 0 | 0 | 0 | 0 | 1 | |
| X | X | 1 | X | X | 0 | 0 | 1 | 0 | 0 | 0 | |
| X | X | 0 | X | X | 0 | 0 | 1 | 0 | 1 | 0 | |
| X | X | X | X | 0 | 0 | 1 | 0 | 0 | 1 | 0 | START GATE COUNT |
| 0 | 0 | X | 0 | 1 | 0 | 1 | 0 | 0 | 1 | 1 | |
| 0 | 0 | X | 1 | 1 | 0 | 1 | 0 | 1 | 0 | 0 | |
| X | 1 | X | X | 1 | 0 | 1 | 0 | L | 0 | 1 | |
| 1 | X | X | X | 1 | 0 | 1 | 0 | 1 | 0 | 1 | SET COUNTER XMIT |
| X | X | X | X | X | 0 | 1 | 1 | 1 | 0 | 0 | |
| X | X | X | X | X | 1 | 0 | 0 | 1 | 0 | 1 | SET LOAD |
| X | X | 0 | X | X | 1 | 0 | 1 | 0 | 0 | 1 | RESET GATE COUNTER |
| X | X | 1 | X | X | 1 | 0 | 1 | 1 | 1 | 0 | |
| X | X | 0 | X | X | 1 | 1 | 0 | 0 | 0 | 1 | RESET LOAD• RESET XMIT CTR |
| X | X | 1 | X | X | 1 | 1 | 0 | 1 | 1 | 1 | |
| X | X | X | X | X | 1 | 1 | 1 | 0 | 0 | 0 | |

PHARMACIST-PROGRAMMABLE MEDICATION PROMPTING SYSTEM AND METHOD

BACKGROUND OF THE INVENTION

The invention relates to apparatus for prompting patients to take medication at prescribed times, and more particularly, to such apparatus and methods which are automatically programmable by a pharmacist.

A variety of machines and devices have been proposed for recording intervals at which patients, especially those under care of an attendant, take medication at periodic intervals prescribed by a physician. If the patient or caretaker ignores the proper instructions and repeats the dosage too frequently or fails to administer or take medication at the proper time, the concentration of medication in the patient's body may become too high or too low. In order to ensure that medications are taken at the proper time, a varietv of devices, such as the one disclosed in U.S. Pat. No, 4,361,408, have been devised to generate audible and/or visual prompting or alarm signals that remind a patient or his caretaker to administer the correct dosage at the correct time. All of these devices have been too complex and costly, inconvenient to program, and have not been flexible enough in establishing varying time intervals at which the medication need to be administered. It would be desirable to have a prompting device which is easily automatically programmable by the pharmacist at the time that the prescription is purchased, thereby overcoming the potential problems that would be associated with a failure to correctly set the time interval or intervals for taking a particular medication.

Accordingly, one object of the invention is to provide a pharmacist-programmable portable medication prompter device that is simple in structure, low in cost, and has the capability of allowing various different prompting intervals to be programmed into it.

In recent years, regulations requiring medication containers to have child-proof caps have been enacted. For some patients, it would be desirable if certain medications were available to them only at the prescribed time in order to prevent such patients from carelessly taking excessive doses of medications such as tranquilizers.

Accordingly, another object of the invention is to provide a pharmacist-programmable prompting device which is incorporated in a locking cap of a medication container and only allows the cap to be removed at physician-prescribed intervals.

There are instances in which it would be desirable for a pharmacist and/or physician to have instant access to a medical history of a particular patient in order to know if a particular prescription should not be administered to that patient or if the times of administering a particular prescription should be synchronized in a particular way with other medications that the patient is receiving.

Accordingly, it is an object of the invention to provide a pharmacist-programmable medical prompting device that stores and makes available medical history information for a particular patient.

Another problem with some prior medication prompter "alarm-clock-like" devices is that they need to be manually reset by the patient or medication administrator each time a medication is dispensed. Failure to reset the device can cause undue drain on the self-contained batteries of the device.

Accordingly, another object of the invention is to provide a pharmacist-programmable medication prompter that does not need to be manually reset each time medication is administered.

Although medication prompting devices have been enclosed in caps of individual medication containers in the past, as disclosed in U.S. Pat. No. 4,367,995, and other devices have been disclosed for monitoring compliance with prescription administering instructions by sensing when a medication cap is removed or when a liquid containing container is inverted, as disclosed in U.S. Pat. No. 4,034,757, these concepts have not yet been incorporated in a practical, low cost, pharmacist-programmable medication prompting device, and no prior art device has yet found extensive utilization in the industry.

It is another object of the invention to provide a low cost, practical pharmacist-programmable medication prompting device that maintains a record of the number of times the cap of the medication container has been removed and/or the record of the times at which the cap of the medication container has been removed.

SUMMARY OF THE INVENTION

Briefly described and in accordance with one embodiment thereof, the invention provides a pharmacist-programmable and/or physician-programmable medication prompting system and method for receiving input information representative of a physician's prescription instructions from an operator, automatically converting the input information to a serial format, transmitting the serial data to a portable prompting device, entering the data into a memory of the prompting device, generating electrical prompting signals at a plurality of predetermined times specified by the prescription instructions and generating audible and/or visual prompting signals in response to the electrical prompting signals at the specified times. In a described embodiment of the invention, the system includes a programming station that is connectable to a local computer in a pharmacist office. The prescription instructions are entered into the computer via a keyboard. The keyboard outputs information by means of an RS232 interface to a programming station. The programming station includes a microprocessor, which in accordance with a stored program, generates a data/clock signal in serial format and transmits it on a single bi-directional data/clock conductor to the medication prompter. The data is in the form of 48 bits each corresponding to successive half hour intervals of a 24 hour day. Each bit is a logical "one" if the medication is supposed to be dispensed at the half hour interval time corresponding to that bit, but otherwise is a logical "zero". The 48 bits are shifted by the medication prompter into a 48 bit shift register comprised in the above-mentioned memory. After the 48 bits are loaded into the shift register, the prompter device goes into a transmit mode wherein it transmits the same 48 bits from the shift register, the prompter device goes into a transmit mode wherein it transmits the same 48 bits from the shift register back to the programming station. The programming station then automatically verifies the accuracy of the 48 bits transmitted back, if there is no error, and then allows the medication prompter to remain in a self-clocking mode. If there is an error in transmission of the 48 bits during the load operation, then the programming station automatically resets the shift register and reloads the 48 bits into the prompter. The verification procedure then is repeated.

After a verified loading of the prescription instruction information in the form of the 48 bits into the medication prompter has been accomplished, the programming station then executes an operation that advances an internal clock circuit of the medication prompter to "offset" the clocking or shifting of the 48 bits in the shift register by an amount of time equal to the difference between the present time of day and the time at which the prescription is to be first administered. After the offset operation has been completed, the medication prompter transfers control of clocking of the shift register to the internal clock circuitry, causing it to shift the 48 bits each half hour. Each time a logical "one" is shifted out of the shift register, the electrical prompting signal is produced. In response to the electrical prompting signal, an alternating beeping signal and flashing of a prompting light occurs to prompt the user to take the medication.

In one embodiment of the invention, the medication prompter is incorporated in the cap of a medication container. The cap is a locking cap having a jack for receiving a pluggable extension of the data/clock conductor of the programming station. The cap also includes a battery, an acoustic transducer, a light emitting diode, and also a ratchet/lock mechanism and an automatic resetting switch. The ratchet mechanism engages teeth on the lip of the container mouth opening to allow closing of the cap, but prevents opening of the cap except when the electrical prompting signal is present. Removal of the cap produces an automatic reset signal that stops flashing of the light and/or the audible beeping. In one embodiment of the invention, the prompting circuit includes circuitry for counting the number of times the reset signal is generated, and in another embodiment stores the times at which the reset signal is produced, thereby providing a record of when medication was actually dispensed. In another embodiment of the invention, the medication prompter is incorporated in a wrist-watch-like device. An LCD (liquid crystal display) alphanumeric display indicates in response to the prompting signals when one or a plurality of different medications should be taken. In another embodiment of the invention, the medication prompter includes a memory storing medical history information for the patient, making it possible for the pharmacist or a physician to determine information relevant to medication for the patient.

DESCRIPTION OF THE INVENTION

Figure 1:
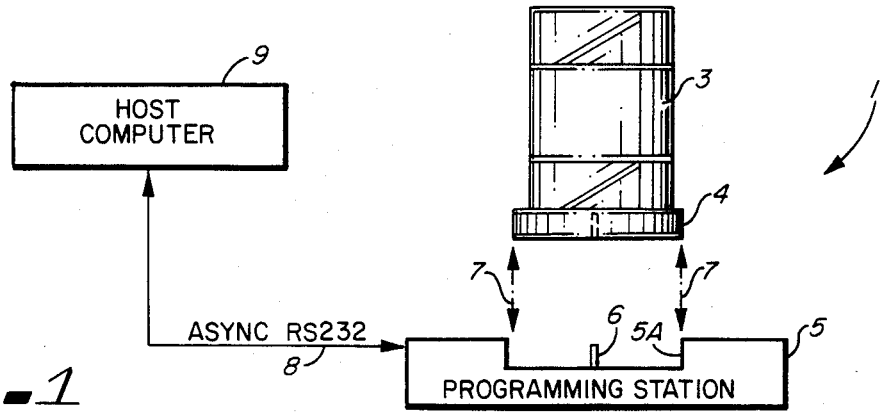
FIG. 1 is a block diagram of the prompting system of the present invention.

Referring now to FIG. 1, system 1 includes a medication container 3 which is illustrated as a pill bottle. Pill bottle 3 has a locking cap 4 thereon. Locking cap 4 includes a prompter 16 having circuitry shown in FIG. 3 and FIGS. 5A–5D. This circuitry is programmable by means of programming station 5 to load a physician's prescription instructions into a memory contained in the circuitry. As subsequently explained, the circuitry in cap 4 generates audible and visible prompting cues or alarm signals at times specified by the prescription instructions.

Figure 4:
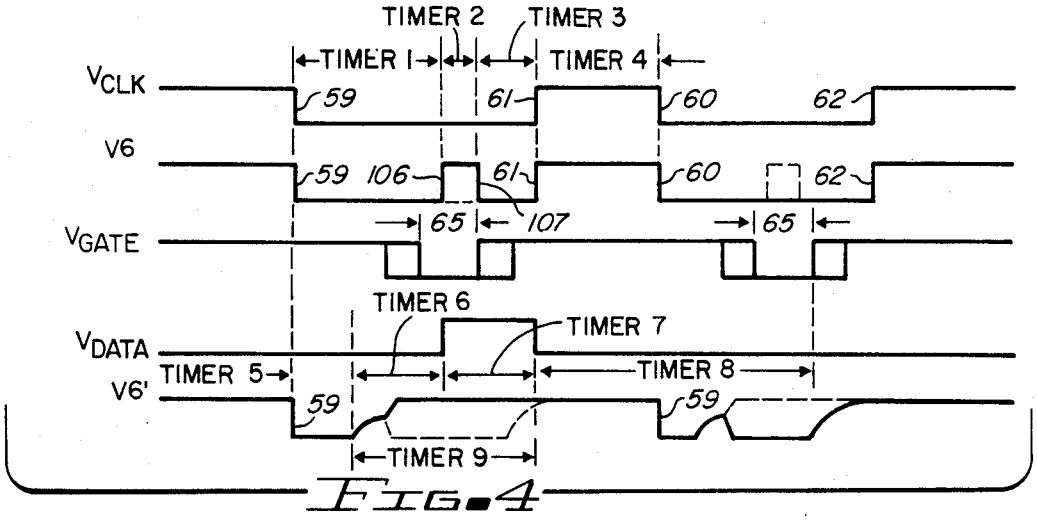
FIG. 4 is a set of waveforms useful in explaining the operation of the block diagram of FIG. 3.

Programming station 5 has a receptacle 5A therein and a male data/clock connector 6 which fits into and makes electrical connection with the data/clock conductor 6 of the circuitry in FIG. 4. Arrows 7 show that the cap 4 can be plugged into receptacle 5A of programming station 5 to accomplish programming of the prompting circuitry in cap 4. Cap 4 then is withdrawn therefrom. Normally, pill bottle 5 with cap 4 and prompting circuitry therein will be kept in possession of the patient. Programming station 5 is stationary and is kept by the pharmacist at his place of business. Programming station 5 is connected by means of a conventional RS232 interface designated by reference numeral 8 to a computer 9, which is also kept at the pharmacist's place of business. Computer 9 is a typical business or personal computer that might perform a variety of functions for a pharmacy. Computer 9 could be connected by means of a modem or other means to a larger central computer or even to one or more remote computers or terminals at various physician's offices.

In accordance with the present invention, the prompter contained in cap 4 then automatically alerts the patient when to take his medicine. The prompter could also take various other shapes, such as the device shown in FIG. 9A wherein reference numeral 10 designates the housing of the prompter circuitry, reference numeral 11 designates a light emitting diode that blinks when it is time for the patient to receive medication, and reference numeral 12 designates a reset button which must be depressed on some embodiments of the invention to stop the light 11 from blinking. Reference numeral 13 designates a ventor preforated portion of the top of the housing which allows audible beeping sounds to emanate from an acoustic transducer contained within. Reference numeral 14 designates an adhesive backing from which protective paper or plastic covering can be removed to allow adhesive attachment of the prompter 10 to a flat surface of the medication container.

Figure 9A:
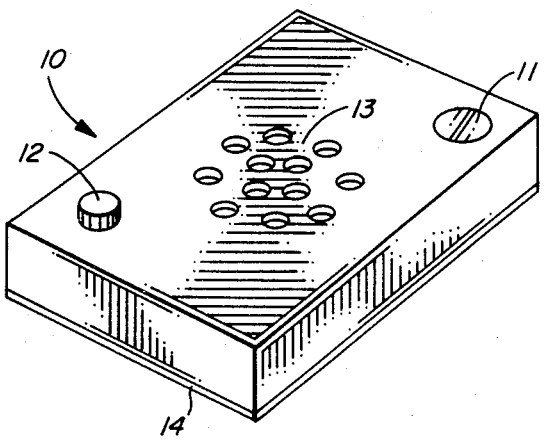
FIGS. 9A and 9B are perspective views illustrating other embodiments of the invention.
Figure 9B:
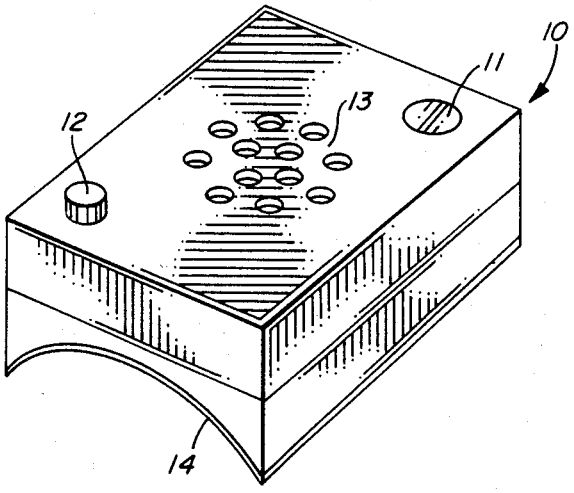

FIG. 9B discloses the same housing as in FIG. 9A, with a curved surface adhesively backed to provide attachment to a cylindrical container.

A somewhat different arrangement can be provided in which the prompter is incorporated in a wrist-like watch device having an LCD display which indicates not only that a medication should not be administered, but also indicates which medication, making possible the prompting of the patient to take several different medications at different times. A simple memory can be included in any of the prompters of the present invention for containing medical history information for a particular patient. This information can be interrogated by the pharmacist's computer or a physician's computer to determine information that is relevant in making a prescription. For example, such information might indicate whether any incompatible medications are being taken by the patient or if he has allergies to any particular medications that might otherwise be accidently prescribed.

Figure 2:
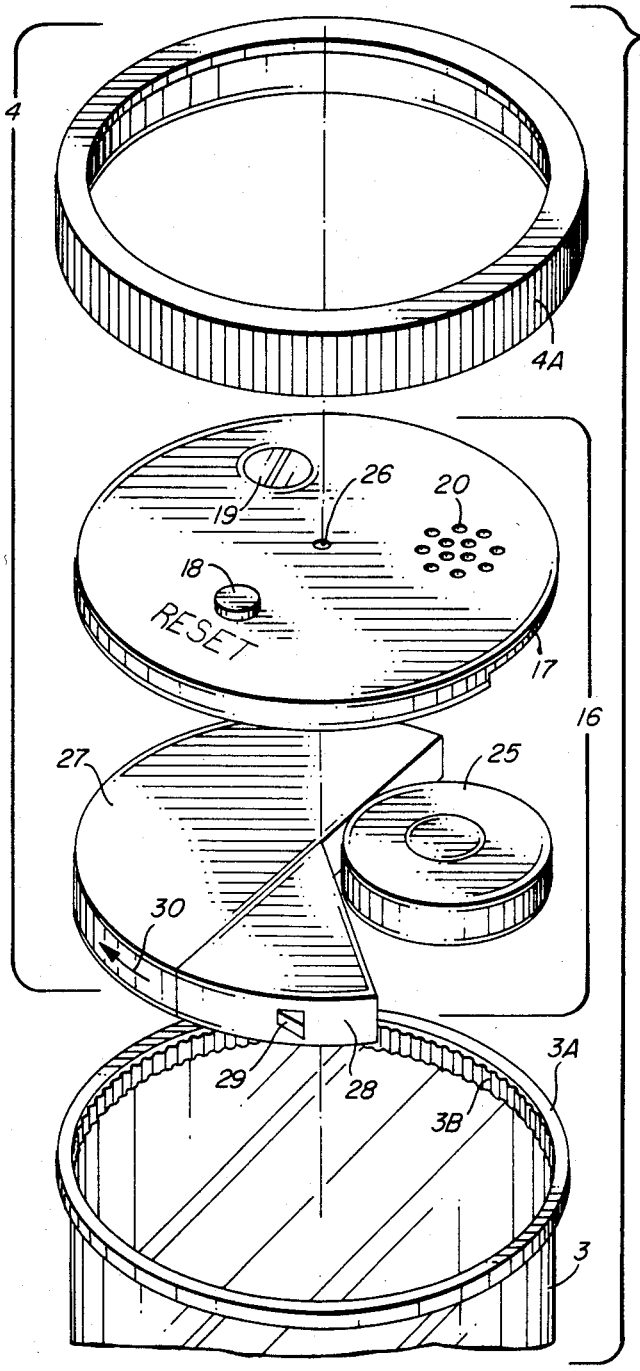
FIG. 2 is a partial perspective exploded view of an embodiment of the invention in which the prompter is incorporated in a locking cap for a medication container.

Referring now to FIG. 2, cap 4 includes a prompter system 16 disposed within its collar 4A. Prompter 16 includes a circuit board 17 which is circular and sealably engages the upper inner surface of collar 4A. Disposed in printed circuit board 17 are a reset button 18, a translucent window 19, and a sounder vent 20. On the bottom side of printed circuit board is a crystal oscillator 20, an integrated circuit 21 containing the circuitry of the block diagram of FIG. 3, a light emitting diode 22 which, when illuminated, shines through translucent window 19, and a cut out portion 23 for receiving a sounder or acoustic transducer 25. Sounder 25 can be a miniature ceramic transducer. Also included in printed circuit board 17 is a female receptacle 26 for receiving and electrically contacting male data/clock conductor 6 of FIG. 1 from the programming station 5.

A suitable battery 27 is contained within cap 4 and is disposed beneath printed circuit board 17. Note that FIGS. 2A and 2B illustrate further details of printed circuit board 17 and the relationship of cap 4 to medication container 3.

Also disposed in cap 4 beneath printed circuit board 17 is a ratchet mechanism 28. A pawl 29 which is controlled by a solenoid (not shown) contained within ratchet mechanism 28 engages the teeth 3B of lip 3A of medication container 3. As cap 4 is rotated in the direction of arrow 30, pawl 29 ratchets freely with teeth 3B, which extend upward into cap 4 between battery 27, ratchet mechanism 28 and sounder 25. This is the direction in which cap 4 is rotated to tighten it onto medication container 3. In order to remove cap 4 from container 3, it is necessary to rotate cap 4 in the direction opposite to arrow 30. Ratchet pawl 29 prevents this direction of rotation unless the solenoid within ratchet mechanism 28 has been actuated in response to integrated circuit 21 and more specifically in response to a prompting signal produced thereby at a time determined by the prescription information that has been programmed into prompter 16.

Figure 3:
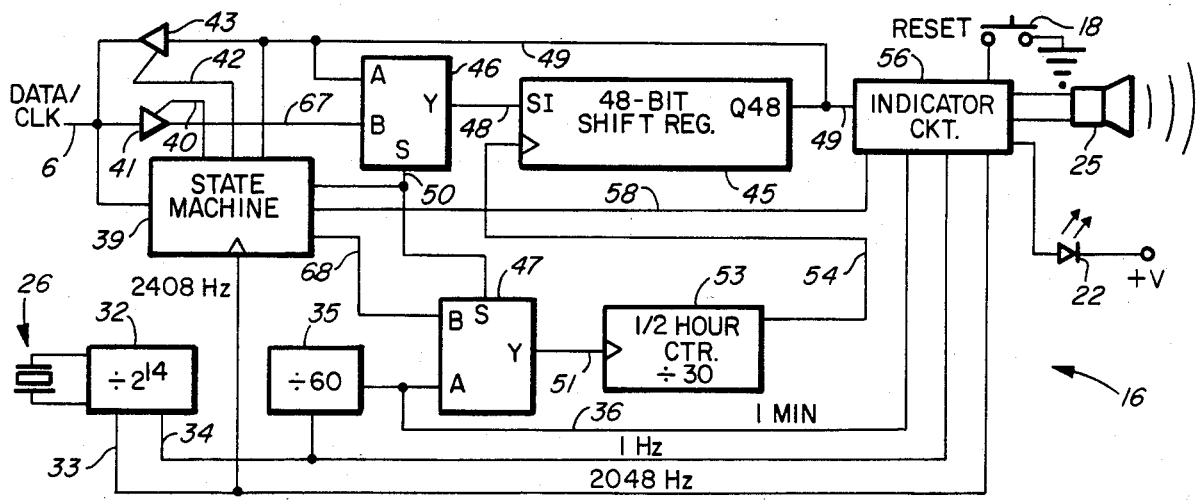
FIG. 3 is a block diagram of circuitry contained in the medication prompter of the present invention.

In order to further understand the operation of the pharmacist-programmable prompting system shown in FIG. 1, it will now be helpful to refer to FIG. 3, which shows a block diagram of the circuitry of prompter 16, and FIG. 4, which shows the waveforms on data/clock conductor 6 and other waveforms useful in explaining the operation of the system of the present invention.

Figure 2A:
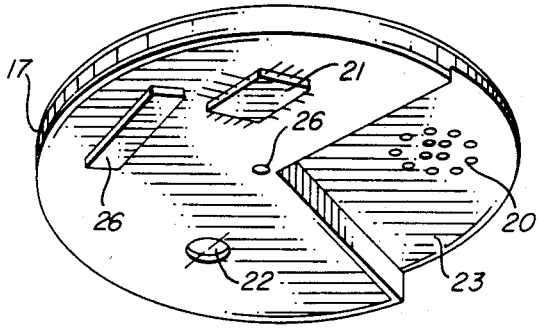
FIG. 2A is a perspective view of the lower surface of the circuit board shown in FIG. 2.
Figure 2B:
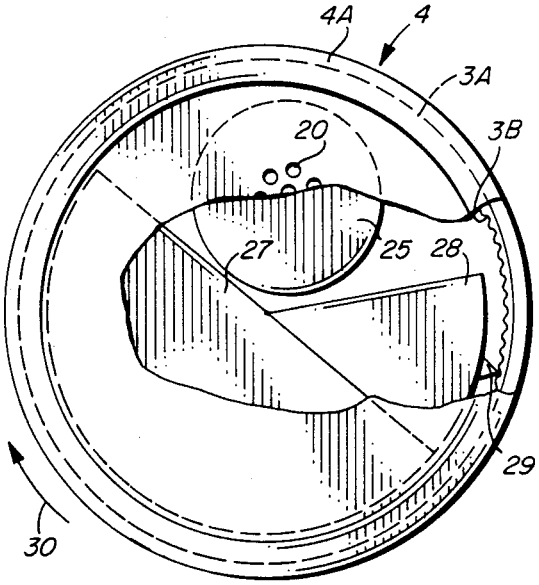
FIG. 2B is a section view of the medication prompter incorporated in the locking cap of FIG. 2 and is useful in explaining the operation thereof.

In FIG. 3, the crystal oscillator 26 shown in FIG. 2A oscillates at 16,384 Hertz, and is connected to a 14 stage binary counter designated by reference numeral 32. One output of binary counter 32 having a frequency of 2,048 Hertz is produced on conductor 33. Another output, designated by reference numeral 34, has a one Hertz signal thereon. Conductor 34 is connected to the input of a divide-by-60 counter 35, the output of which produces a pulse every minute on conductor 36. Conductor 36 is connected to the "A" input of multiplexer circuit 46. It should be noted that both binary counter 32 and counter 35 can be readily implemented by those skilled in the art, so that the details of these circuits are not disclosed.

Conductor 33 also is connected to an input of a circuit referred to herein as "state machine" 39. Details of state machine 39 are shown in FIGS. 5A and 5B.

State machine 39 has an input connected to data/clock conductor 6. State machine 39 performs mainly the function of facillating separating of the data and clock signals produced on half duplex data/clock conductor 6. State machine 39 generates an enable signal on conductor 42 to enable three-state driver circuit 41. State machine 6 also generates an enable signal on conductor 42 to enable three-state driver circuit 43, the output of which is connected to data/clock conductor 6. The input of three-state driver 43 is connected to both state machine 39 and to the output of a 48 bit shift register 45. Those skilled in the art can readily implement such a 48 bit shift register, so its details are not shown.

The circuit shown in FIG. 3 includes two multiplexers 46 and 47. The output of multiplexer 46 is connected to the shift input 48 of shift register 45. The A input of multiplexer 46 is connected to conductor 49. The B input of multiplexer 46 is connected to the output of three-state driver 41. The select or S input of multiplexer 46 is connected to conductor 50, and determines whether the A input or B input of multiplexer 46 is electrically coupled to its Y output 48. Conductor 50 is connected to state machine 39, and is also connected to the S or select input of multiplexer 47. The Y output 51 of multiplexer 47 is connected to the clock input of a half-hour divide-by-30 counter designated by reference numeral 53. Again, divide-by-30 counter can be easily implemented by those skilled in the art, so its details are not shown. The B input of multiplexer 47 is connected to an output of state machine 39. The 30 minute clock output 54 of counter 53 is connected to the clock input of 48 bit shift register 45, causing it to shift every half-hour when the A inputs of multiplexers 46 and 47 are "selected".

The output 49 of shift register 47 is connected to an indicator circuit designated by reference numeral 56. Circuit 56, the details of which are shown in the circuit FIG. 5D, generates the signals needed to drive previously mentioned light emitting diode 22 (FIG. 2A) and sound transducer 25. Reference numeral 18 designates the reset button both in FIGS. 2 and 3. The one minute pulse conductor 36, the one Hertz conductor 34, and the 2048 Hertz conductor 33 are all connected as inputs to indicator circuit 56. An output 58 from state machine 39 is also connected to circuit 56.

At this point, it will be helpful to refer to the timing diagram of FIG. 4 to explain the operation of the prompter circuit 16 shown in FIG. 3. In FIG. 4, waveform V6 designates the signal produced on data/clock conductor 6 by programming station 5. Waveform V6 includes a clock signal and a data signal. The "separated" clock signal, which appears on conductor 68 of FIGS. 3 and 5C, is shown in the waveform designated $V_{CLK}$. The leading edge of the clock signal of data/-clock conductor V6 is always generated by the programming machine, as subsequently explained with reference to the flow charts of FIGS. 8A–8C, and two such leading clock edges are designated by reference numerals 59 and 60 in FIG. 4. The trailing edge of the clock signal are designated by reference numerals 61 and 62 in FIG. 4.

The "separated" data signal is designated by $V_{DATA}$ in FIG. 4, and appears on conductor 67 in FIGS. 3 and 5C. This is the output of three-state driver 41 of FIG. 3 which is schematically shown as being conducted via the B input of multiplexer 46 to the shift input of shift register 45. However, this function is accomplished by means of NAND gate 96 and "recovery" flip-flop 102 in FIG. 5C.

The $V_{CLK}$ waveform in FIG. 4 designates an internal signal generated on conductor 40 by state machine 39 to produce a "data window" designated by reference numeral 65 at which time state machine 39 allows the level on data/clock conductor 6 to be interpreted as data.

During the loading process during which programming station 5 loads 48 bits of prescription instruction information into shift register 45, programming station 5 generates 30 indentical sequential clock and data pulses representing one bit of information on data/clock conductor, causing state machine 39 to generate 30 pulses on conductor 66 and, hence, cause counter 53 to generate one shift pulse on conductor 54 and cause loading of that bit into shift register 45.

The waveform designated V6′ in FIG. 4 is the signal that appears on data/clock conductor 6 during a "verify" operation in which the 48 bits initially loaded into shift register 45 are re-transmitted back from prompter 16 to programming station 5 for verification. For the V6′ waveform, state machine generates a transmit data window on conductor 42. During this window, the data at the output of shift register 45 is gated onto data/clock conductor 6 and transmitted back to programming station 5. However, the leading edges 59 on data/clock conductor 6 are still generated by programming station 5, thereby causing the state machine to generate the necessary 30 pulses on conductor 66 that are needed to cause counter 53 to generate one pulse on conductor 54 to cause shifting of one bit out of shift register 45.

The one Hertz clock pulse on conductor 34 controls the beeping rate of transducer 25 and the blinking rate of light emitting diode 22 whenever a logical "one" is shifted out of shift register 45 onto conductor 49 when prompter 16 is in its prompting mode. The 2048 Hertz pulse on conductor 33 controls the audible frequency emitted by sound transducer 25. The one minute pulse on conductor 36 disables the sound transducer after one minute, to thereby minimize excessive drain on the batter if the patient does not respond quickly to the prompting signals. The light emitting diode 22 continues to blink at a one second rate until reset button 18 is depressed.

Figure 11:
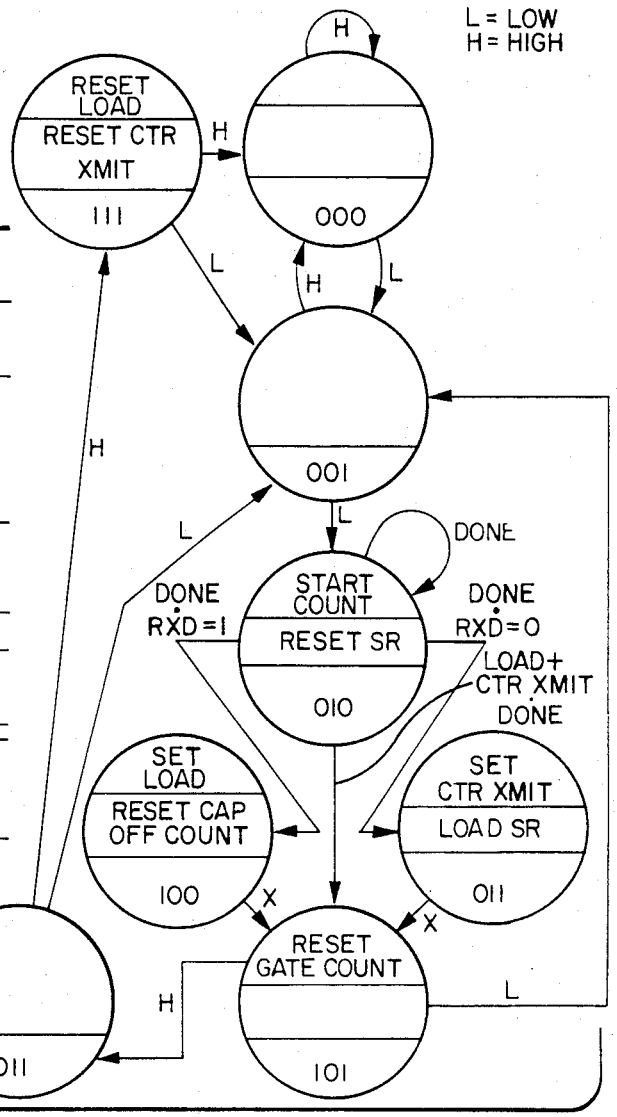
FIG. 11 shows a state machine and truth table of logic circuitry of FIGS. 5A–5D modified to incorporate the circuitry of FIG. 10.

At this point, it may be helpful to one skilled in the art to relate the information shown in the block diagram of FIG. 3 to the detailed logic diagram of FIGS. 5A–5D. State machine 39 includes the circuitry shown in FIG. 5A. The logic gates and flip-flops shown implement the logic equations represented by the truth table of FIG. 11. FIG. 11 also shows a state diagram representing the operations performed by state machine 39. In state machine 39, reference numeral 70 designates the initial state 000. If the data/clock line 6 is low, the state machine goes to 001 state 71. If data/clock line 6 is at a logical "1", the state machine refers back to the 000 state 70, but advances to the start count state 010 designated by reference numeral 72 if the data/clock line 6 is low. The counter represented by flip-flops 73 in FIG. 5B begins counting when state machine 39 is in the 010 state. The state machine remains in that state, as indicated by reference numeral 74, until the counter 73 is decoded by the AND gate 75 in FIG. 5B to produce the DONE signal on conductor 76. When the DONE signal is produced, the counter advances to the 011 state 77 and resets the counter 73 and then advances to the 100 state 78. If the data/clock line 6 is low, the state machine reverts to the 001 state, and if data/clock line 6 is high, the state machine goes to the 101 state 79. Then, if the data/clock conductor 6 is low, the state machine revers to the 001 state 71, but it advances to the 110 state 80 if the data/clock line is high. Then, if the data/clock conductor 6 is low, the state machine reverts to the 001 state, but if the data/clock line is high, the state machine advances to the 111 state 81 and generates a RESET LOAD signal on conductor 82 that allows prompter circuitry 16 to remain in its "transmit" mode wherein the counting operations necessarv to internally load clock shift register 45 occurs. The state machine then goes to the 000 state.

The start count signal $\overline{\text{STCNT}}$ produced by state machine 39 in its 010 state 72 (FIG. 6) is produced on conductor 85 of FIG. 5A and FIG. 5B. This signal is coupled by gate 86 and flip-flop 87 to the clock inputs of the three D type flip-flops 73 in FIG. 5B. When these three flip-flops have been advanced from all "0's" to all "1's", as a result of the 2048 Hertz signal on conductor 33, the signal DONE is produced on conductor 76 to indicate that the sampling of data on data/clock conductor 6 is complete.

The circuitry in FIG. 5B decodes the signals produced in the circuitry of FIG. 5A to generate the signal on conductor 50 in FIG. 3 actually includes two conductors 50A and 50B shown in FIG. 5B. These signals determine if the prompter circuit is in the "receive" mode during which the 48 bits of prescription information data are being loaded into shift register 45 from programming station 5 or whether the prompter circuit is in the "transmit" mode wherein either the 48 bits are being retransmitted back to programming station 5 for verification or, if there is a long enough delay with clock/data line 6 high for the state machine 39 to count through all eight of its states to allow self-clocking to occur.

The conductor 88 on which the signal $\overline{\text{XMIT}}$ is produced and applied as an input to the circuit of FIG. 5B, is produced when a start bit is transmitted from programming station 5 to prompter 16. The $\overline{\text{XMIT}}$ signal indicates that shift register 45 now is full and initiates retransmission of the 48 bits therein back to programming station 5 for verification.

Figure 5D:
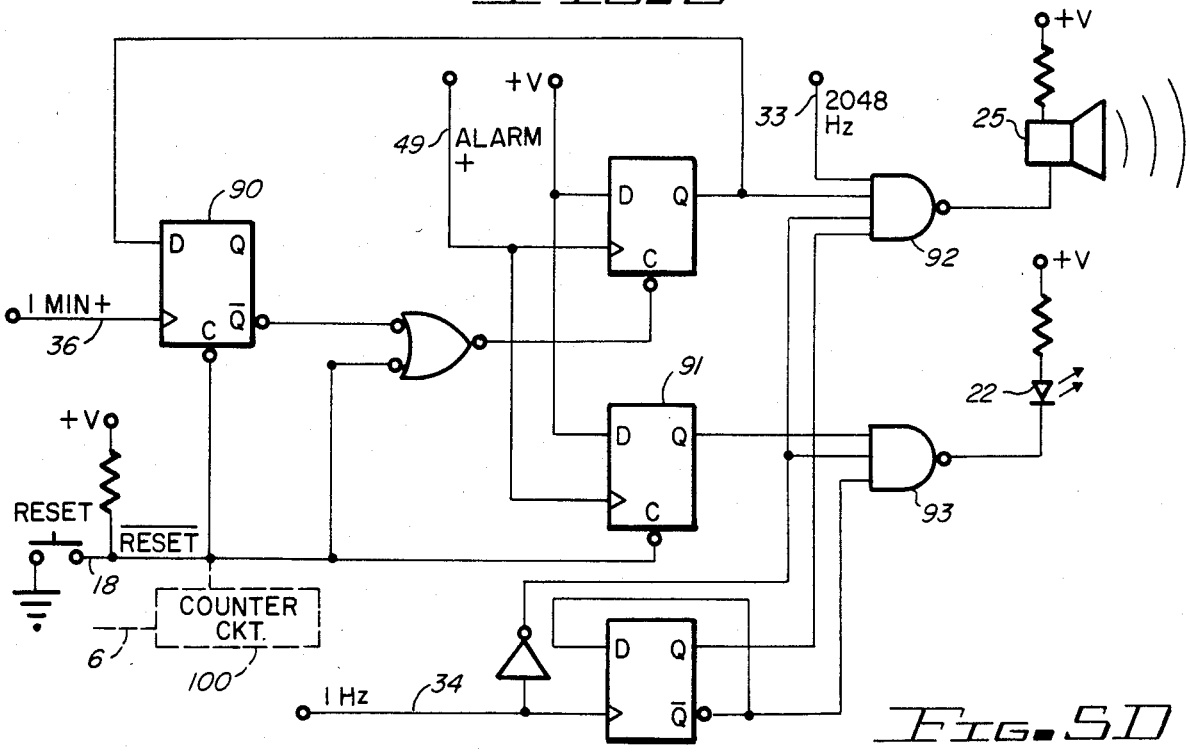
FIGS. 5A, 5B and 5D together comprise a detailed logic diagram of the circuit shown in the block diagram of FIG. 3.
Figure 5A:
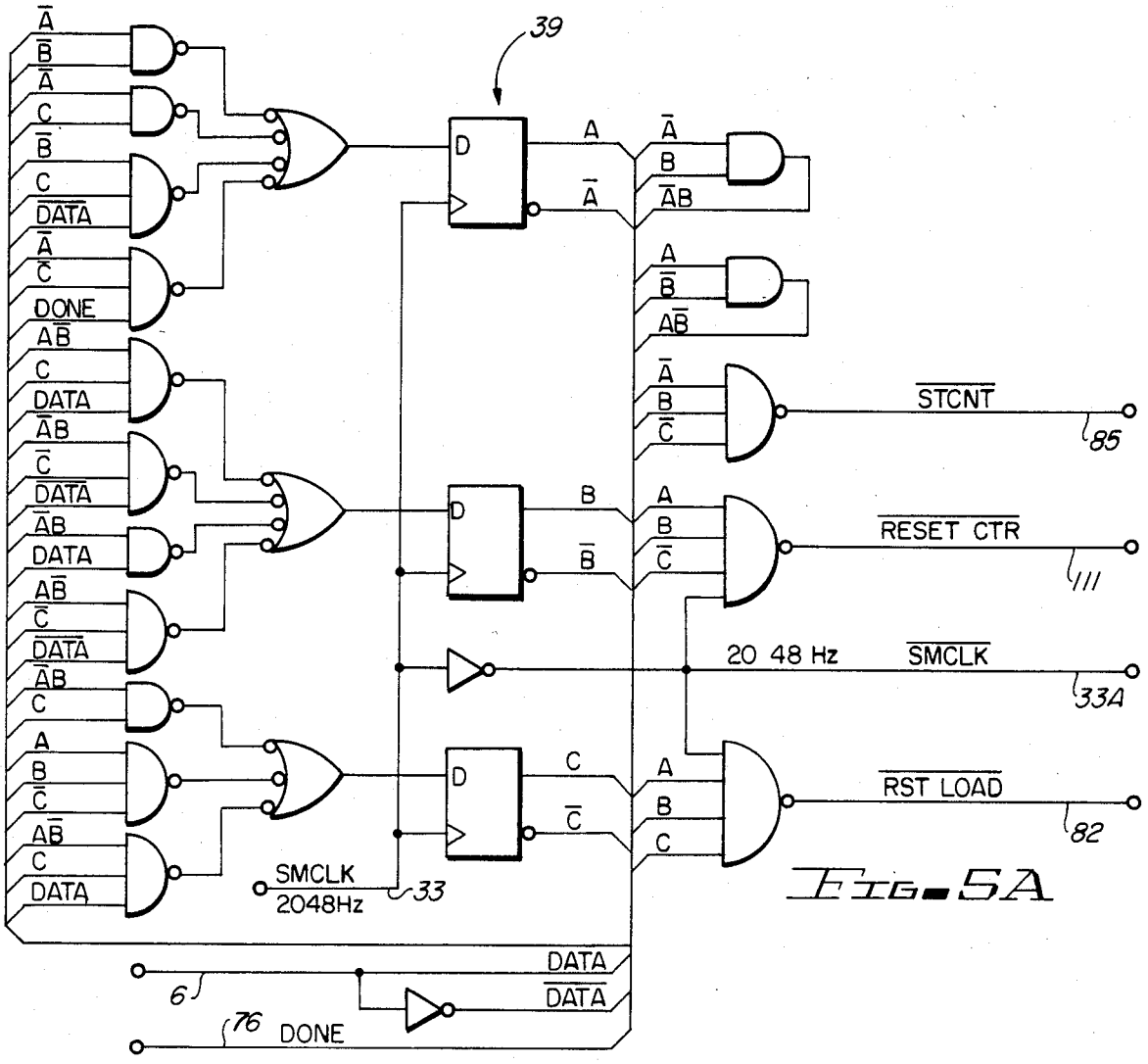
Figure 5B:
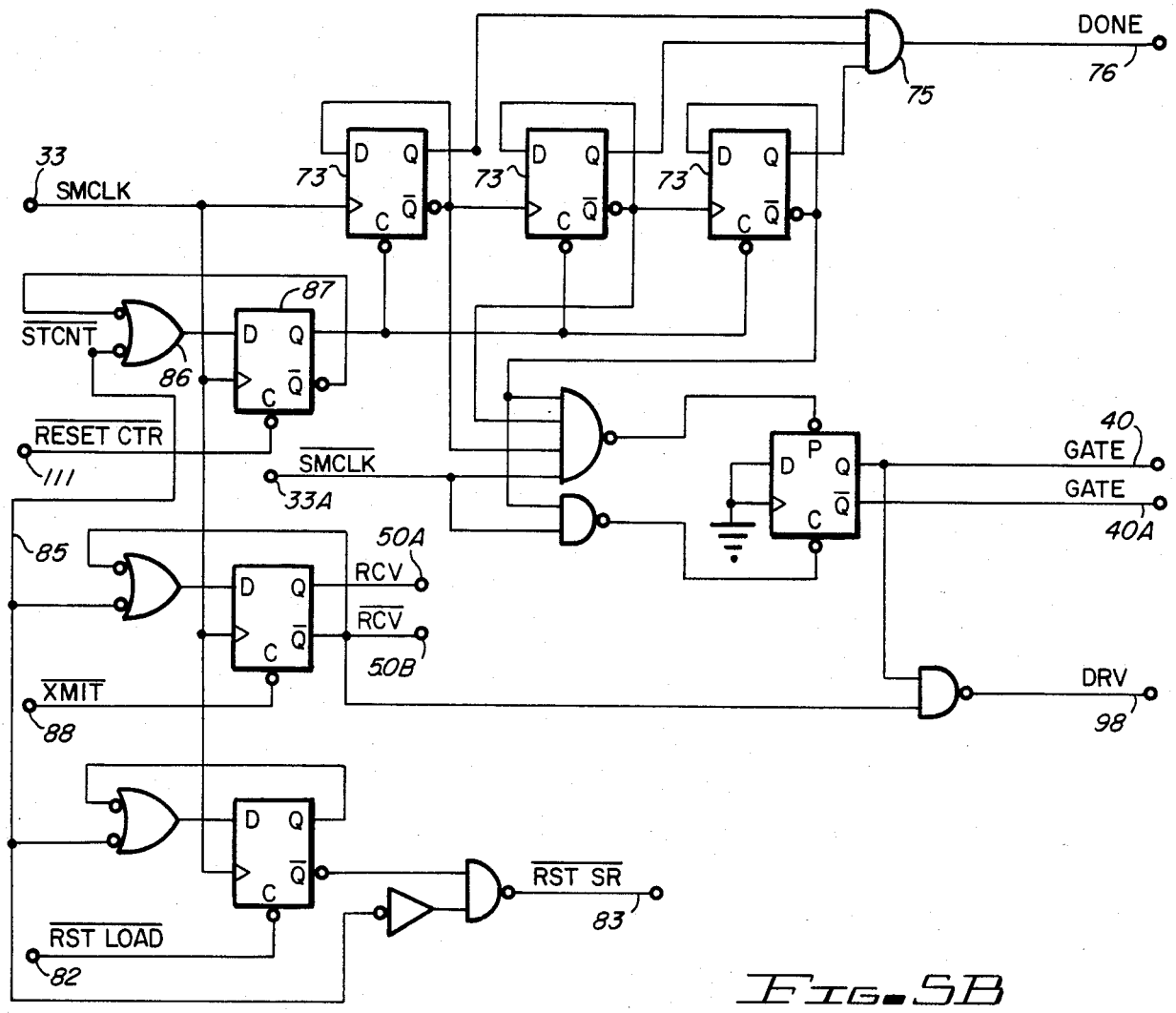

The circuitry shown in FIG. 5D includes a flip-flop 90 which is clocked by the one minutes pulse on conductor 36 and receives the reset signal from reset switch 18. The contents of flip-flop 90 are altered the first minute after a "one" is shifted out of shift register 45 on conductor 49 or when the reset switch 18 is depressed, whichever occurs first. This stops the beeping of acoustic transducer 25. Depressing of the reset swtich 18 also resets flip-flop 9, in FIG. 5D, turning off blinking light emitting diode 22. The one Hertz signal on conductor 34 is applied as an enable input to gates 92 and 93 to establish the one second beeping and blinking rates. The signal inversion produced by inverter 94 in FIG. 5D causes the beeping and blinking of acoustic transducer 25 and light emitting diode 22 to alternate, minimizing the maximum current drain on the battery.

Figure 13C:
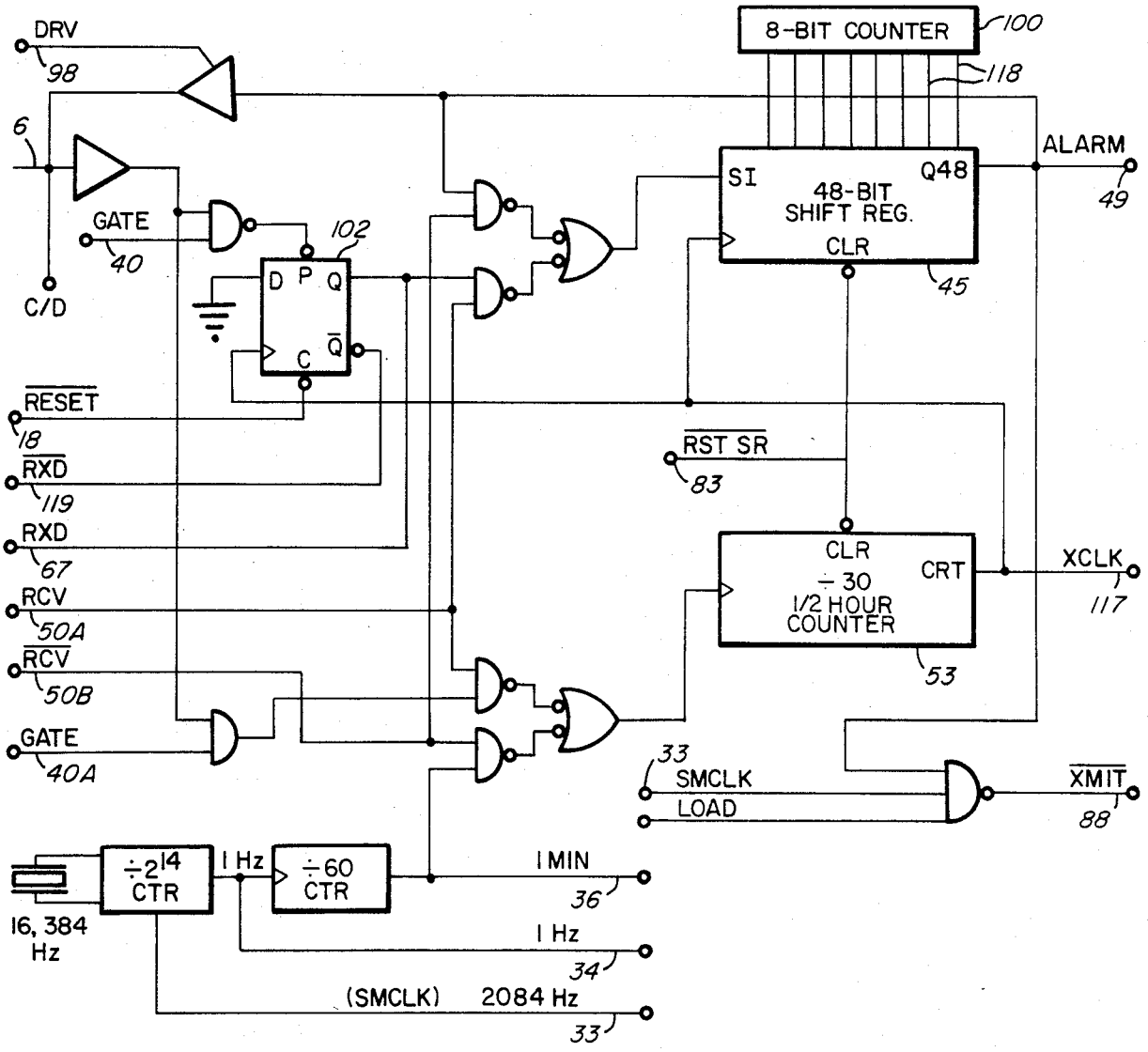
FIG. 13A–13D constitute a detailed logic diagram of a modified version of the circuitry of FIGS. 5A–5D incorporating the circuitry of FIG. 10.

The device shown as a three-state inverter 41 in FIG. 3 is actually implemented by NAND gate 96 in FIG. 13C. The control input on conductor 40 and its complement on conductor 40A determine the duration and position of data window 65 of the $V_{CLK}$ waveform in FIG. 4.

The $\overline{DRV}$ signal produced on conductor 98 in response to the $\overline{RCV}$ signal on conductor 50B and the GATE signal produced on conductor 40 performs the function of enabling three-state driver 43 in FIG. 13C to allow retransmission of data from shift register 45 back to data/clock conductor 6.

In an alternate emobdiment of the invention, the reset signal produced by reset switch 18 is used to clock counter circuitry designated by reference numeral 100 in FIG. 5D to indicate the number of times the reset switch has been actuated. This circuitry is actuated to shift the count out in serial format along data/clock conductor 6. In another embodiment of the invention, a duplicate of shift register 45 is incorporated in the circuit and is clocked each time shift register 45 is clocked. Each time the reset signal is produced by switch 18, the input of this additional shift register is set to a logical "one", whereby the contents of the additional shift register indicate precisely when medication was taken by the patient. This shift register, however, must have enough bits last for the intended duration of the prescription. A variety of other circuits for storing the time of each reset signal could be easily implemented by one skilled in the art.

In another embodiment of the invention, reset switch 18 is incorporated in cap 4 so that it is automatically actuated either every time the cap is removed, or every time it is replaced. This could be implemented by causing reset switch 18 as shown in FIG. 2 to extend through the bottom of printed circuit board 17 near the peripheral portion thereof to engage lip 3A of medication container 3 and slightly modifying the circuitry with latch circuitry for storing the state of the reset switch.

Figure 7:
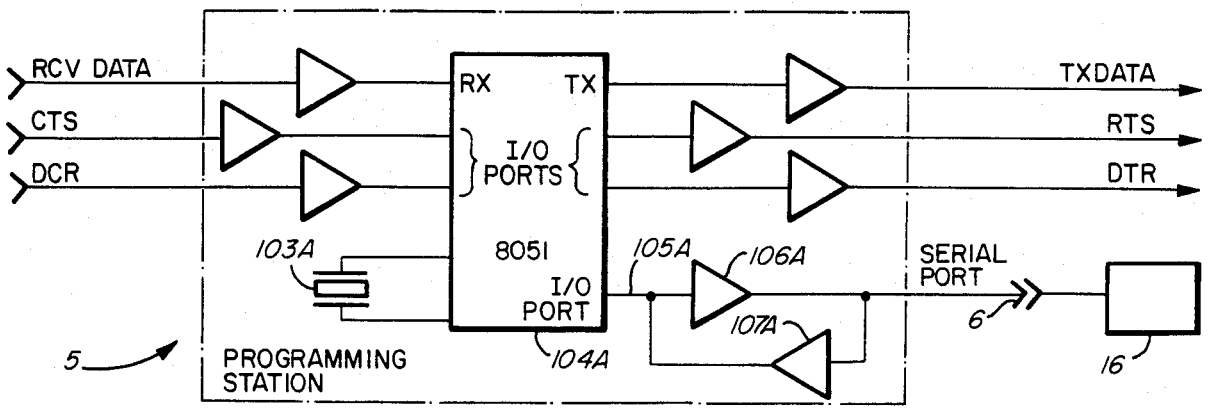
FIG. 7 is a block diagram of the programming station shown in FIG. 1.

The internal configuration of the described programming station 5 is shown in FIG. 7. Programming station 5 includes a microprocessor 104A, which can be implemented by means of an Intel 8051 integrated circuit microprocessor having an I/O port 105A, which is connected to the input of driver circuit 106, into the output circuit of driver 107A. The output of driver 6A and input of driver 107A are connected to data/clock conductor 6, which, as previously explained, is connected as a half-duplex bus to the data/clock conductor of prompter 16. Microprocessor 104A is driven by a suitable crystal oscillator 103A. Its various input/output ports include receive data, (RCVDATA), transmit data (TXDATA), clear to send (CTS), request to send (RTS), data communications ready, (DCR), and data terminal ready (DTR) signals as shown. These are conventional RS 232 interface signals and the associated circuitry and coupling to a conventional computer can be easily accomplished by those skilled in the art without further description.

Figure 8A:
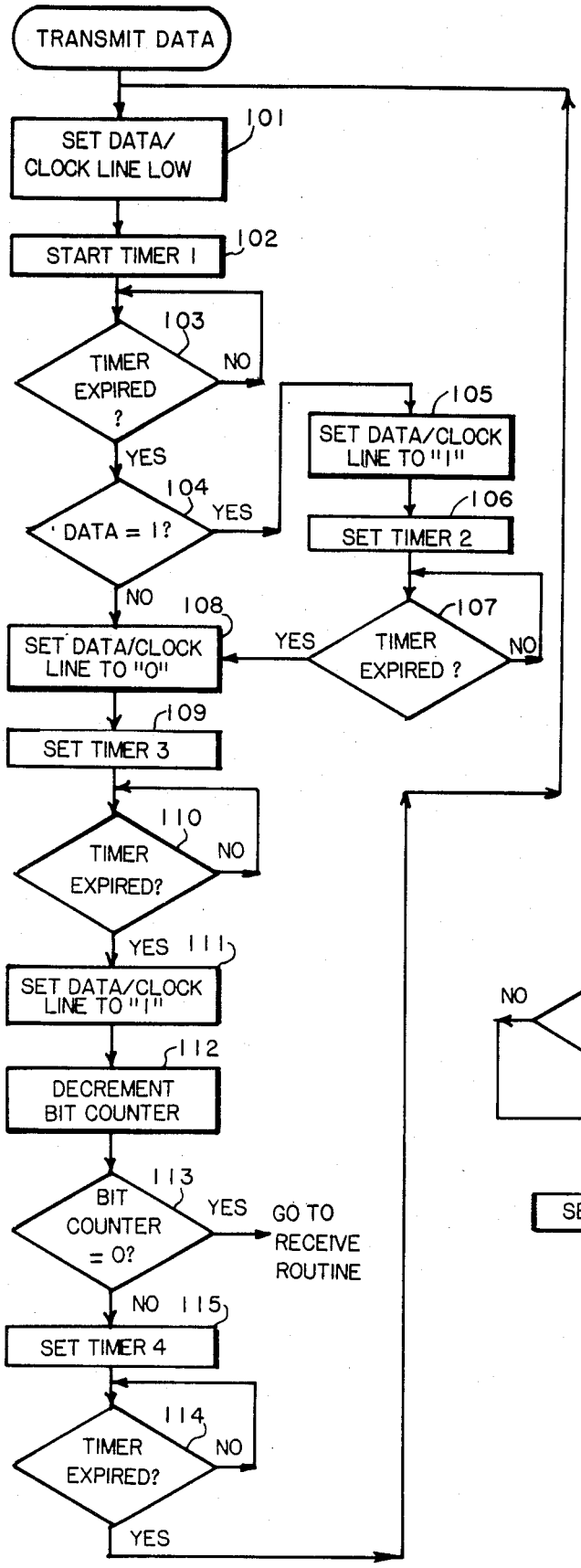
FIGS. 8A–8C are flow charts of the subroutine executed by the programming station in FIG. 1 to effectuate a complete load, verify and offset sequence of operation necessary to properly program the medication prompter shown in FIG. 1.
Figure 8C:
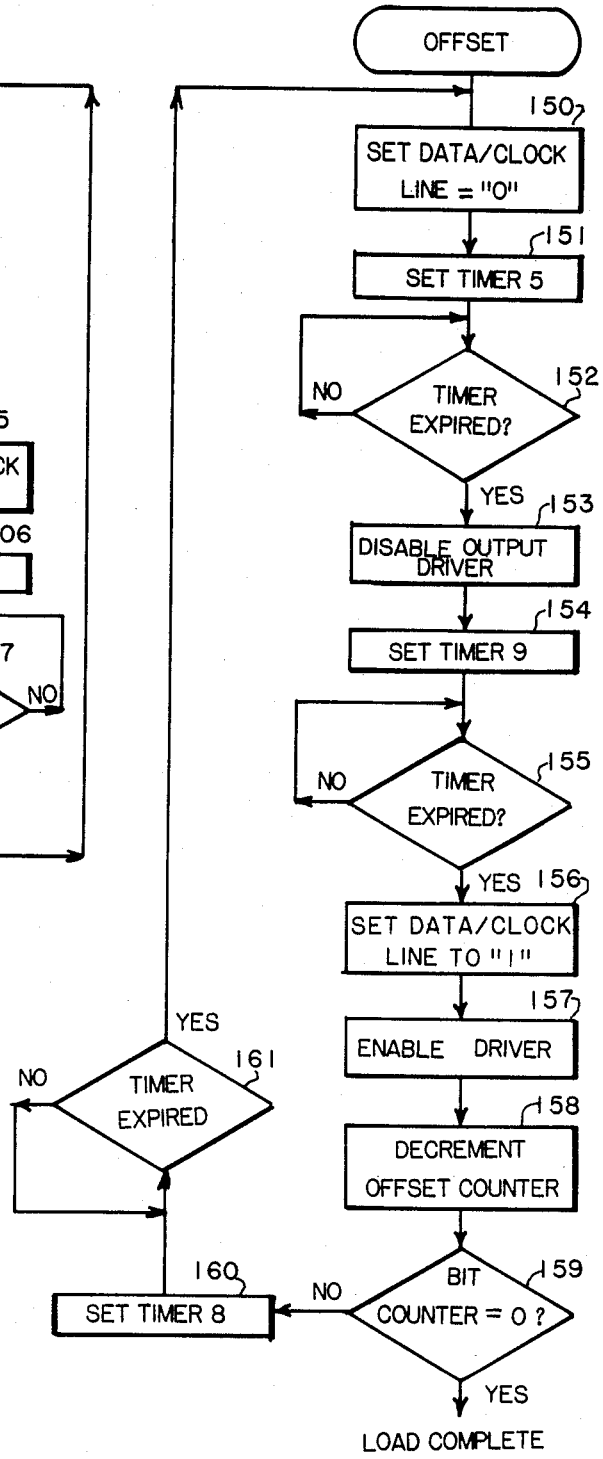
Figure 8B:
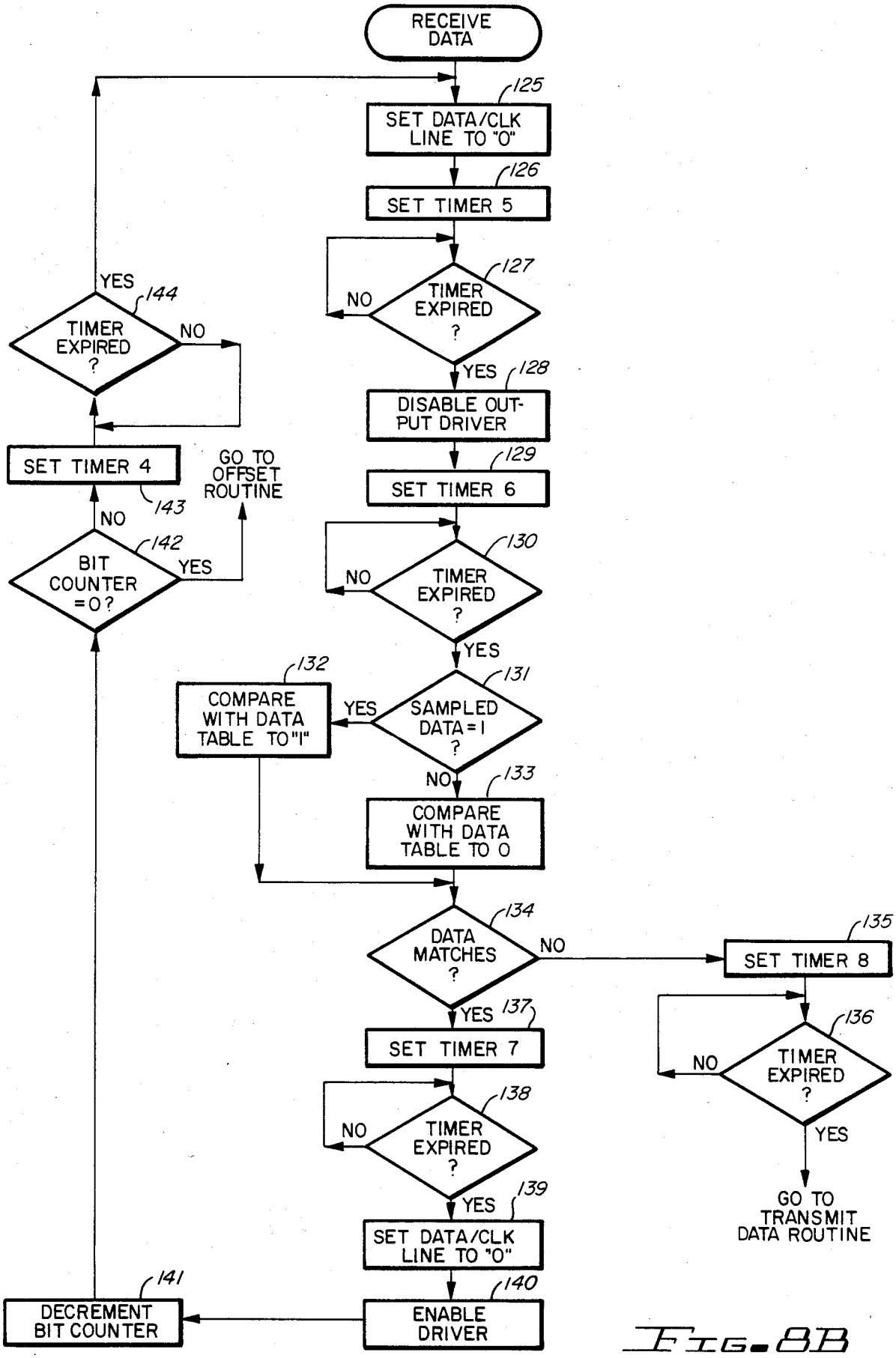

The flow charts of FIGS. 8A–8C represent the programs that are executed by the microprocessor 104 to effectuate operation of the programming station 5. These flow charts can be routinely converted to machine executeable object code by any skilled programmer and represent the most useful way of communicating the information to a programmer in a form from which a list of program instructions can be written for any particular microprocessor.

Referring now to the flow chart of FIG. 8A, which represents the program executed to transmit the desired 48 bits from programming station 5 to shift register 45, the first thing that happens in the transmit data routine is that the microprocessor 104A sets the data/clock line 6 low, as indicated by block 101. In block 102, the microprocessor sets up a first timer called TIMER 1, which counts to establish the interval between the leading edge 59 of the data/clock and the beginning of the interval during which the data will be asserted by microprocessor 104A, i.e., the time indicated by reference numeral 106 in FIG. 4. In decision block 103, the microprocessor loops until TIMER 1 expires. At this point, the time has elapsed to the point at which the data needs to be asserted, i.e., output on the data/clock line 6.

Next, microprocessor 104A checks the programming inputs generated by the pharmacist to see if the present data bit is to be a "one" or a "zero". This is done in decision block 104. If the data bit is to be a "one", the program goes to block 105 and sets the level on the data/clock line 6 to a logical "one". The determination of block 104 is performed by looking at a software table which has been created, containing the desired logic levels for each of the 48 bits to be loaded into the promptor shift register 45. By referring to this table, the decision of block 104 is made. (Recall that the information ordinarily will be transmitted to the programming station 5 by an RS 232 port 8 (FIG. 1) from any suitable host computer 9. The programming station 5 configures that data into a form that is useable by the prompter 3).

In block 106, the program sets a second timer called TIMER 2, which is the amount of time during which the data is to be asserted on data/clock line 6. See FIG. 4. In decision block 107, the microprocessor 104 "idles" until the TIMER 2 elapses. In this case, or if the data to be asserted is a "zero", the subroutine goes to block 108 and sets the data/clock line to zero. The program then goes to block 109 and sets a timer called TIMER 3 (See FIG. 4). (Note that most commercially available microprocessors have internal timers that can be loaded and timed, or the timers can be purely software timers).

During decision block 110, the microprocessor 104A loops or idles until TIMER 4 elapses. The program then sets the trailing edge of the data/clock line 6 to a "one". This represents the trailing edge 60 of the clock. That is the time between the falling edge 107 of the data bit and the rising edge 61 of the clock pulse. Note that initially, the data/clock line 6 is high.

Next, the program goes to block 112 and decrements the "bit count", which is stored in a software counter that initially is set to 48. In decision block 113, the program determines if the present bit cout is zero; if so, all 48 bits have been transmitted in the data/clock line 6 to the prompter 3. The program then goes to the "receive data" subroutine of FIG. 8B, during which the 48 bit data stream that was loaded into shift register 45 then is re-transmitted back to the program station 5 for verification.

If the present bit is not the 48th bit transmitted from programming station 5 to prompter 3, the program goes to block 115 and sets a fourth timer called TIMER 4 to determine the time between the trailing edge 61 and leading edge 60 of the data/clock signal V6. The program then goes to decision block 114 and waits for TIMER 4 to elapse and then returns to block 101 and continues the foregoing sequence until the "bit count" has been decremented to zero. The program then goes to the "receive data" subroutine of FIG. 8B.

Referring to FIG. 8B, the program goes to block 125 and sets the data/clock line 6 low. The program then goes to block 126 and sets a fifth timer called TIMER 5 (FIG. 4). (Note that during the receive data operation, the programming station 5 is controlling the clock signal, even though it is receiving data). TIMER 5 determines the distance between the leading edge 59 of the clock signal $V_{clk}$ and the time at which the programming station 5 begins to "tri-state" the data/clock line 6. The state machine in promptor 3 in fact senses essentially the same but slightly larger amount of time as the delay introduced by TIMER 5. When the programming station 5 tri-states the data/clock line, it lets it electrically "float". After TIMER 5 has elapsed, prompter 3 turns on its drivers. Thus, there is no overlap of time during which the programming station line drivers 106A and 107A (FIG. 7) and the prompter drivers 41 and 43 (FIG. 3) are simultaneously on.

In decision block 127, the program station subroutine waits for TIMER 5 to expire and then goes to block 128. Here, the program disables or tri-states the output data/clock line driver 106A and goes to block 129. In block 129, the programming station subroutine sets a timer called TIMER 6 which determines the amount of time that the programming station 5 will wait until it can safely assume that the data output on the data/clock line 6 by prompter 3 is stable. When TIMER 6 has expired, the program goes to decision block 131 and, by reference to a software stored table in which the values of the 48 bits transmitted to the prompter were stored earlier, determines if the presently received bit on the data/clock line 6 is a "one" and if it is, compares that "one" to the appropriate bit of the foregoing data table, as indicated in block 132, or if the present sampled bit is a "zero"; performs the same operation in block 133. The program then goes to block 134 and determines if the sampled or received data bit matches corresponding bit originally transmitted.

If the determination of block 134 is that the data received does not match the data transmitted for the corresponding bit, the program goes to block 135 and sets the value of a timer called TIMER 8. The program in this event goes to decision block 136 and idles until TIMER 8 has expired and then goes to the transmit data subroutine of FIG. 8A.

TIMER 8 is a long valued timer, because a long delay is the only way that prompter 3 has of knowing that the load sequence is complete. TIMER 8 is of long enough duration for the prompter 3 to "time out", and during this time, programming station 5 prevents data/clock line 6 from undergoing any transitions.

If the data received does match the data sent for the present bit, the program goes to block 137 and sets a timer called TIMER 7. After timer 7 expires, in decision block 138, the program goes to block 139 and sets the data/clock line to a logical 1.

TIMER 7 is a time interval between when the programming station 5 has sampled the data output for line 6 by prompter 3 and when programming station 5 turns its output driver 106A (FIG. 7) back on again. At that point, i.e., at the end of TIMER 7 in block 139, the program sets the data/clock line 6 to a logical "one" and then goes to block 140 and turns on tri-state driver 106A. Meanwhile, prompter 3 turns off its output drivers prior to the time at which programming station 5 turns its drivers 106A back on. This avoids any overlap during which both units try to drive the data/clock line 6.

The program then goes to decision block 142, determines if the present bit is the last of the 48 bits and if it is, the program goes to the offset routine of FIG. 8C, but if it is not, the program goes to block 143 and sets TIMER 4, which determines the time that must elapse before the data/clock line 6 goes low again. Note that if the program does make an affirmative decision in decision block 142, this means that all of the data that was transmitted to the prompter has now been verified.

After TIMER 4 has expired, the receive data subroutine returns to block 125 and continually repeats the foregoing sequence until all of the 48 bits have been verified or until a mismatch has been found.

In the offset routine of FIG. 8C, the programming station 5 can assert additional clock pulses in order to establish the proper time "offset" necessary to synchronize the prompter with the present time of day. The program goes to block 150, sets the data/clock line 6 low to produce the leading edge 59 of the clock signal. The program then sets TIMER 5 as indicated in block 151, waits for TIMER 5 to expire, as indicated in block 152 and then goes to block 153 and disables the output driver 106A of the programming station 5. The program then sets a timer called TIMER 9, as indicated in block 154. TIMER 9 counts the amount of time from when the programming station "tri-states" the data/clock line 6 and the time at which the programming station is going to take control of the data/clock line 6 again. As indicated in decision block 155, when TIMER 9 expires the program goes to block 156 and sets the desired value of the clock signal to a "one" and then goes to block 157, enables the output driver 106A to then produce a "one" on the data/clock line 6. Next, the program decrements an offset counter, as indicated by block 158, and then goes to decision block 159. If, in decision block 159, the program determines that the count is zero, this means that an offset stored in the offset counter has been programmed into the prompter 3, and the program indicates that the loading operation by the programming station is complete. If the offset has not been completely programmed into the prompter, the program goes to block 160 and sets TIMER 8, waits for it to expire, reenters block 150 and continues the previously described cycle of operations until the offset counter count is equal to zero. The initial value of the offset counter is established in the software executed by the host computer or by the programming station computer on the basis of the present time of day and the time at which the first pill is to be taken by the patient. The offset is in one minute increments plus half hour increments. For example, if the first pill is to be taken at four P.M., and it is now 10:22 A.M., and the prompter 3 is now being programmed by programming station 5, then the offset is 11 half-hour increments plus 8 one minute intervals.

Figure 12:
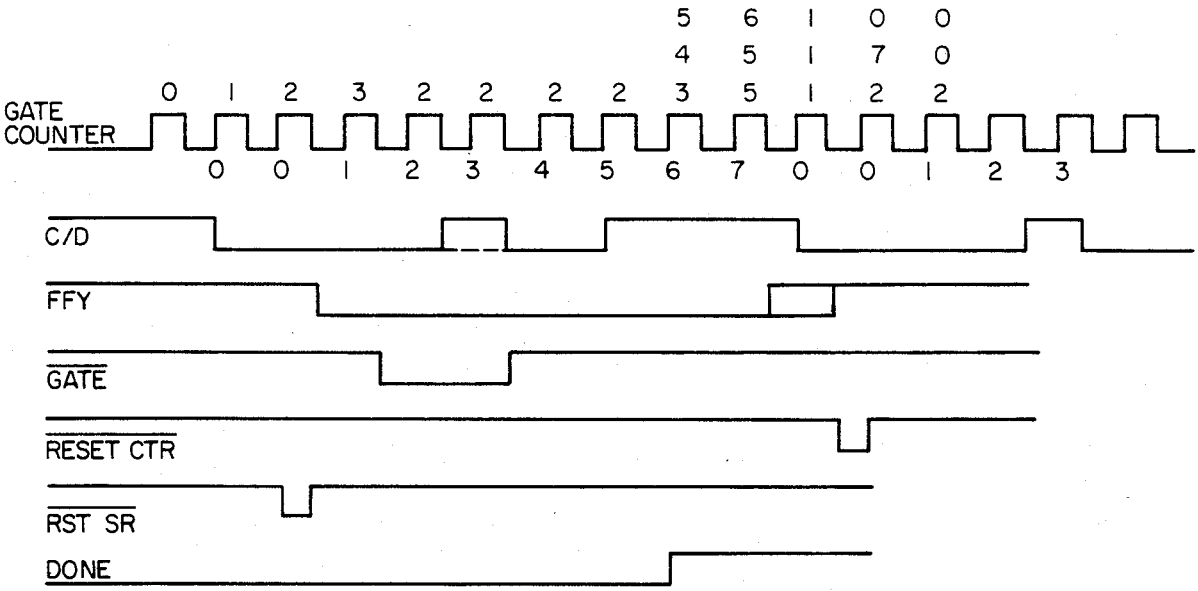
FIG. 12 is a timing diagram illustrating the operation of the circuitry of FIGS. 13A–13D.

Now that the complete structure and operation of the embodiment of the invention shown in FIGS. 5A–5D has been described, a more detailed description of how counter circuitry 100 in FIG. 5D can be implemented will be set forth. In order to provide a complete description that would enable one skilled in the art to incorporate a practical version of counter 100, FIGS. 10–12 and FIGS. 13A–13D are provided to show the complete circuitry as modified to incorporate the counter. The waveforms of FIGS. 12 are very similar to those of FIG. 4. However, the state diagram of FIG. 11 is different in several significant respects from the state diagram of FIG. 6. As a result, some features of the "state machine" portion of the diagram shown in FIG. 13A and some of the circuitry shown in FIG. 13B are somewhat different that corresponding circuitry shown in FIGS. 5A and 5B. The precise differences will be explained subsequently.

Figure 10:
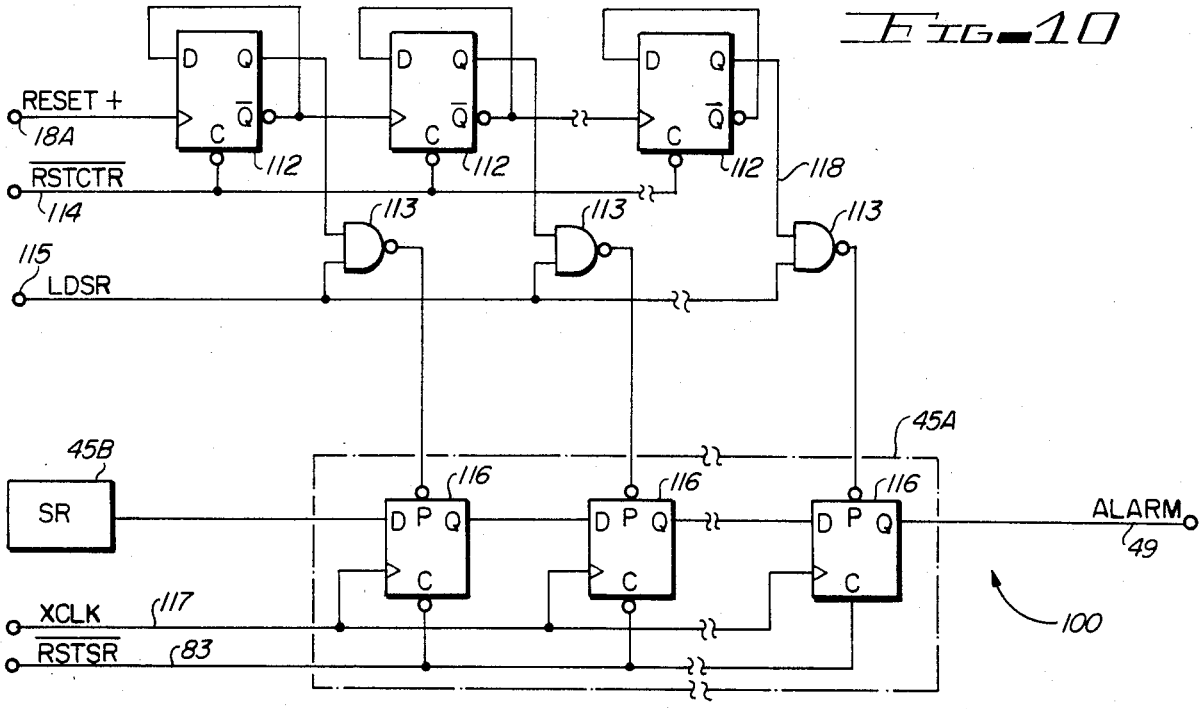
FIG. 10 is a logic diagram illustrating a counter which can be incorporated into the circuit of FIGS. 5A–5D to automatically count the number of times the circuit has been reset and output that count to the programming station of FIG. 1.

Referring now to FIG. 10, counter 100 is implemented by means of eight D-type flip-flops 112. The Q output of each of the D flip-flops 112 is connected to one input of a two input NAND gate 113. The $\overline{Q}$ output of each D type flip-flop 112 is connected both to the clock input of the next D type flip-flop in counter 100, and is also connected back to its own D input. The clock input of the left hand D flip-flop in FIG. 10 is connected to RESET conductor 18A. The clear (C) input of each of flip-flops 112 is connected to a conductor 114 on which the signal $\overline{\text{RSTCTR}}$ (reset counter) is conducted.

The second input of each of the two input NAND gates 113 is connected to a conductor 115 on which the signal LDSR (load shift register) is conducted.

The outputs of the respective NAND gates 113 are connected to the P (preset) inputs of bits 41–48 of shift register 45 (FIG. 3). Dotted line 45A in FIG. 10 generally designates these last eight bits of shift register 45, and reference numerals 45B designates the first 40 bits of shift register 45.

As shown in FIG. 10, bits 41–48 of shift register 45 are implemented by means of D type flip-flops 116. The clock input of each of D type flip flops 116 is connected to conductor 117, which conducts the signal XCLK. The signal $\overline{\text{RSTSR}}$ is connected on conductor 83, which is connected to the clear inputs of each of the D type flip flops in shift register 45.

In FIG. 13C, it can be better seen how eight bit counter 100 of FIG. 10 is connected by conductors 118 to the last eight bits of 48 bit shift register 45. Except for this change, FIG. 13C is very similar to FIG. 13D. Note that the output of half hour counter 53 appearing on conductor 117 is designated XCLK. This conductor is connected to the clock input of D type flip flop 102, previously described. (Note that the same reference numerals are used to designate the same part of FIGS. 5A–5D and 13A–13D, respectively). The two outputs of flip-flop 102 are now designated RXD on conductor 67 and $\overline{\text{RXD}}$ on conductor 119. NOR gate 99 of FIG. 5C has been omitted in FIG. 13C.

Figure 13D:
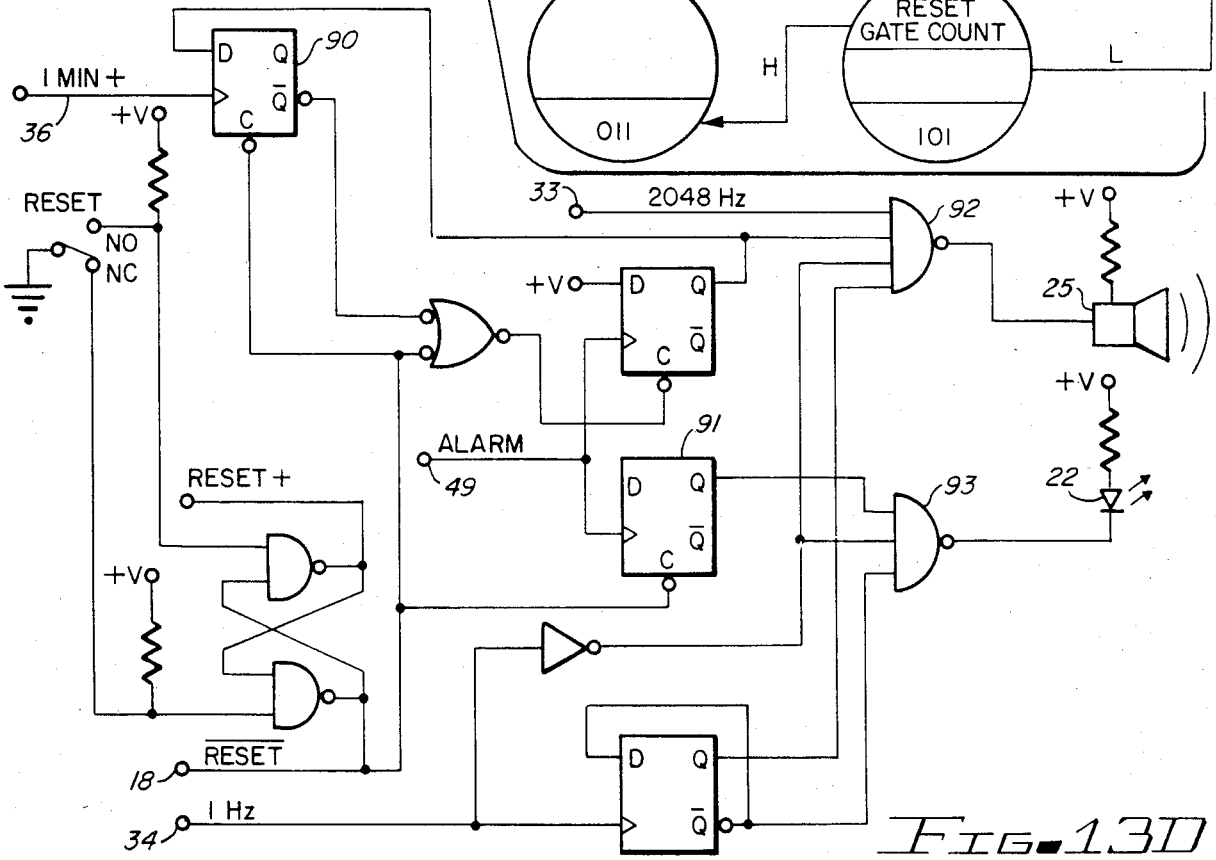
Figure 13A:
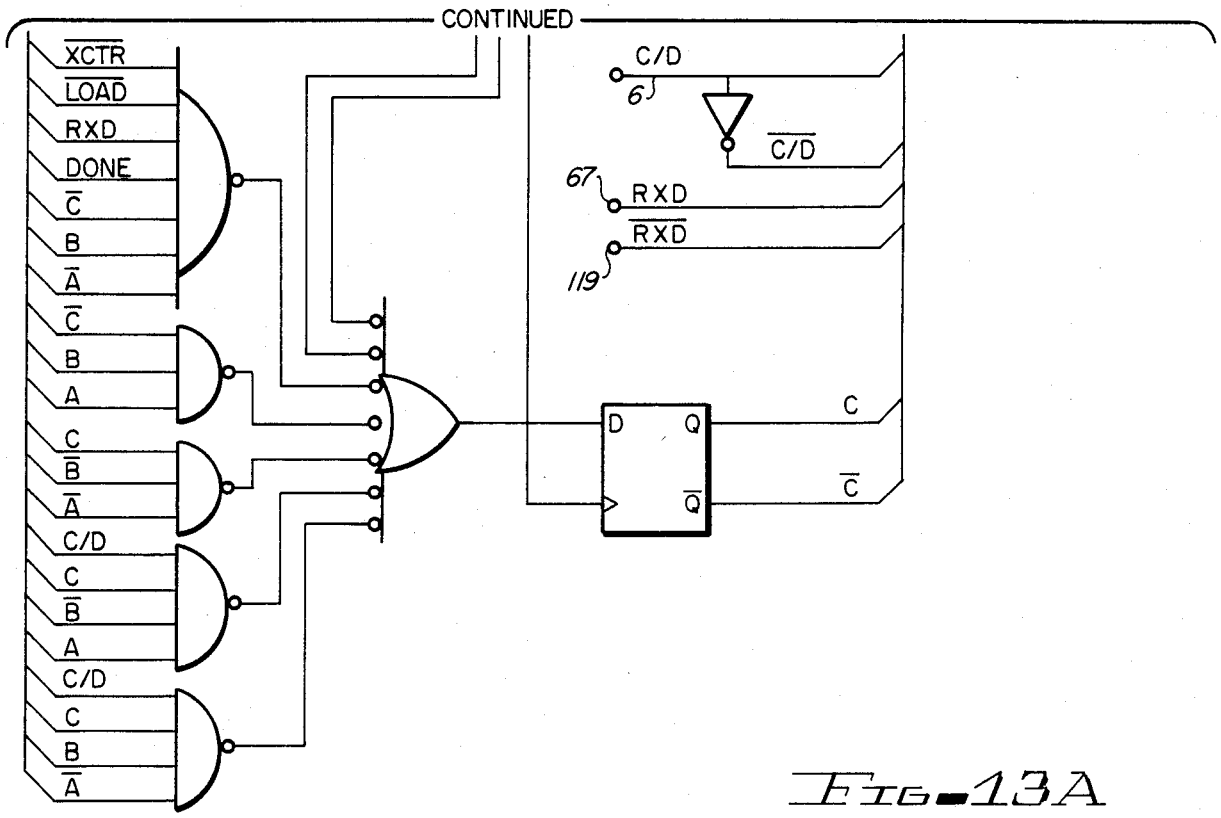
Figure 13A:
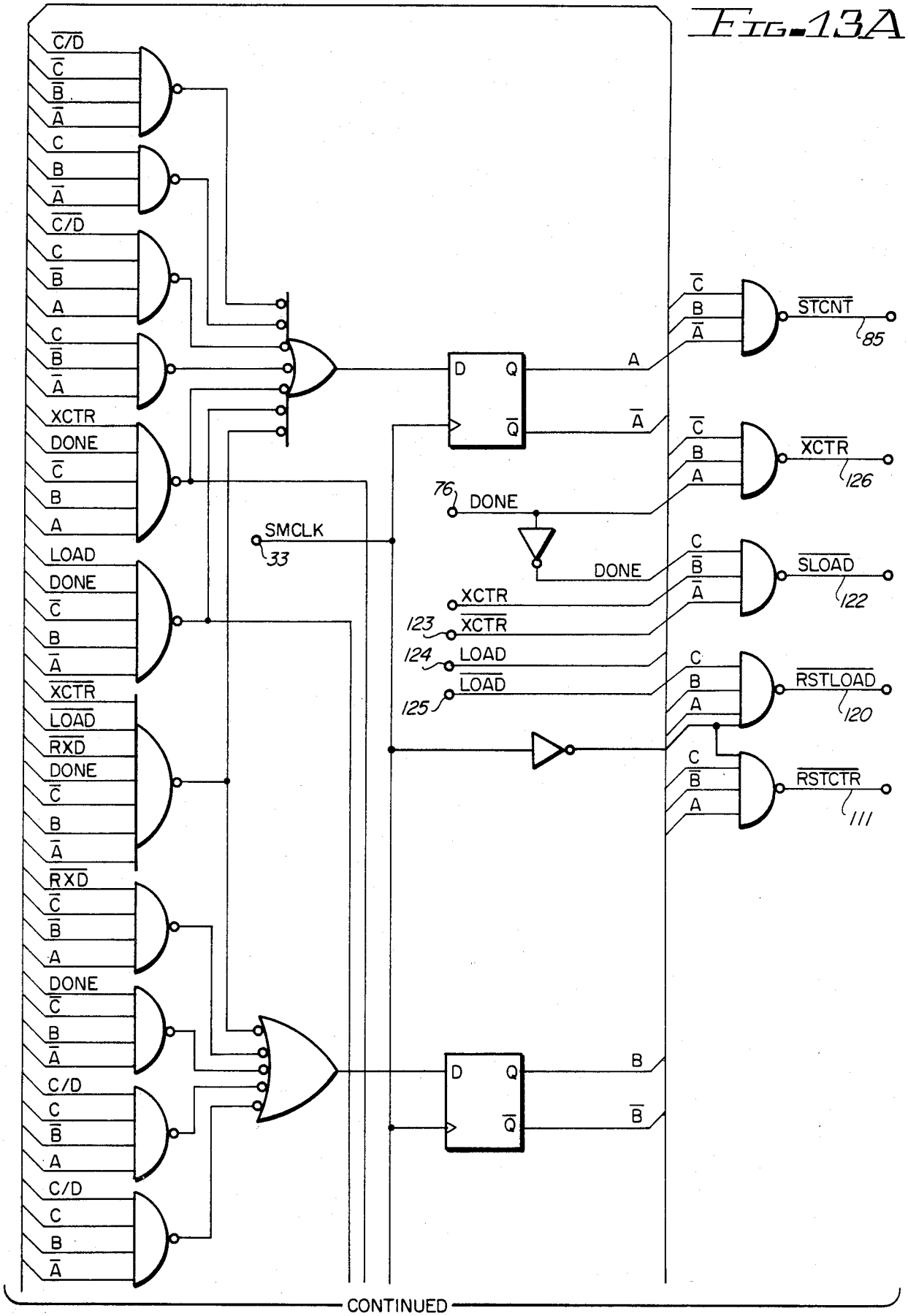
Figure 13B:
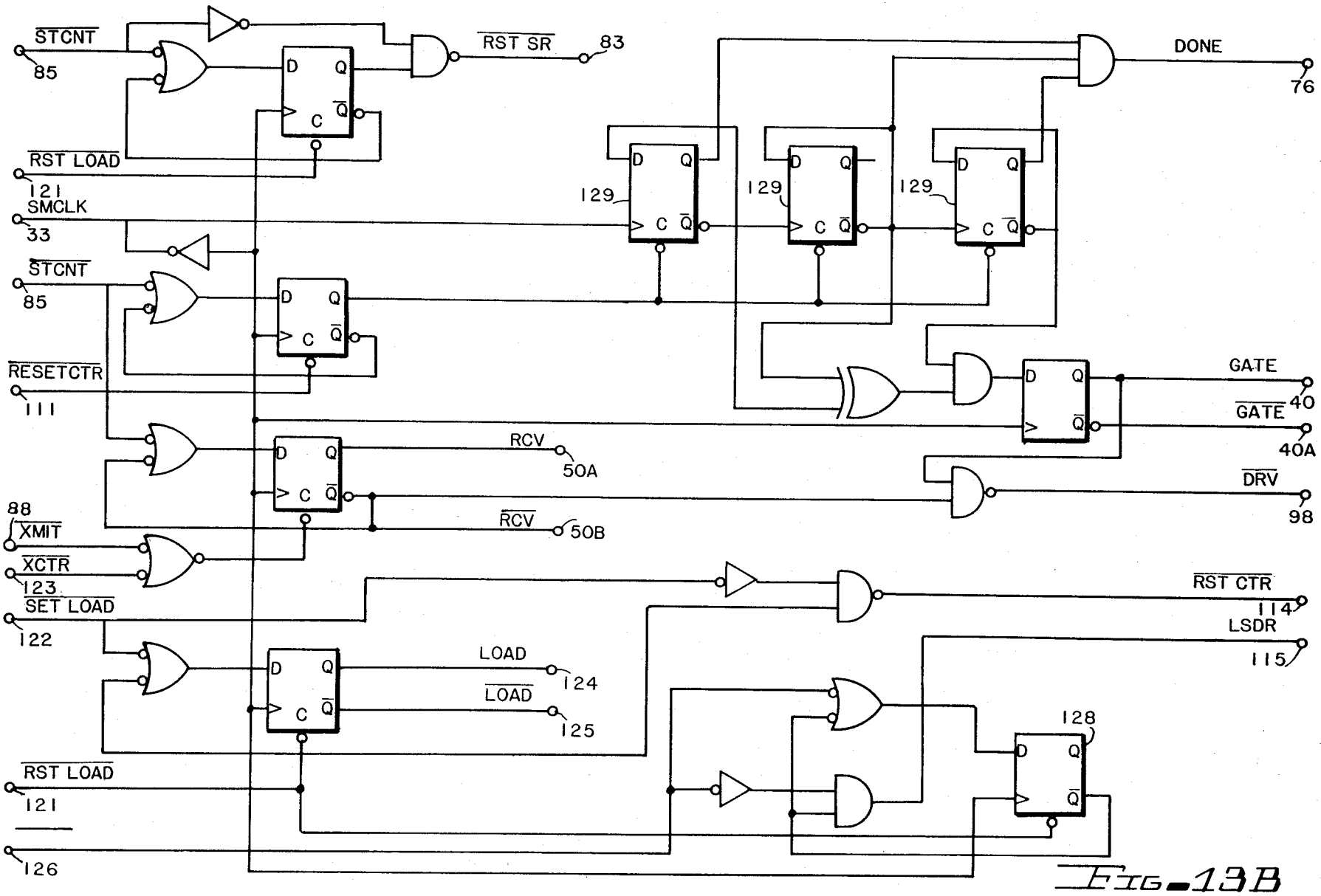

FIG. 11 shows a state diagram of the state machine shown in FIG. 13A for the case when the counter 100 is included. The first bit received on the data clock line 6 causes the state machine to do a load sequence, in which case the state machine represented by FIG. 11 performs the same function as the previously described state machine of FIG. 6. If the first bit received on the data clock line is a "zero", then the modified system and the modified state machine cause the contents of the above-mentioned counter 100 to be loaded into the last eight bits of shift register 45 and then transmitted to programming station 5, which then can determine how many times the reset signal 18 of the prompter 16 has been reset.

The new state diagram shown in FIG. 11 looks at the new received data bit value on data/clock conductor 6. If it is a "zero" in state 010, the state machine goes into its "counter transmit" mode in state 011. If the received data bit is a "one" for a sufficiently long time, the state machine goes into its "load" mode. If the received data (RXD) is a "one", the state machine represented by FIG. 11 does the same thing that the previously described state machine did, namely it goes into its load mode and resets the "cap off counter" 100 in state 100. (The term "cap off counter" is being used because a desirable way of generating the reset signal 18 is to automatically generate it in response to removal of the cap shown in FIG. 2 from the medication container).

The state diagram of FIG. 5, after doing the previously two mentioned tasks in state 100, goes to state 101 and resets the gate count, just as was done in the third "011" state in the state diagram of FIG. 6. Then, if the received data signal on the data clock conductor is a "one" the state diagram of FIG. 11 goes to state 011. If the received data signal is high, the state diagram goes from state 011 to state 111, resets the load and reset the transmit mode and goes back to state 000 and waits for another transition of the data/clock conductor 6. This is essentially the same sequence as for the state diagram of FIG. 6.

However, in the state diagram of FIG. 11, if the first received data bit is a "zero", then the state diagram goes to state 91. In state 011, the state machine of FIGS. 13A and 13B cause a "transmit cap counter 100" flip flop to be set. It also loads the shift register 45, or more specifically, the last eight bits thereof, with the contents of the cap counter 100, which stores a count of how many times the cap of the medication container has been removed. The eight bits of counter 100 would count 256 reset signals. (If the medication container contains more than 256 pills, for example, the length of cap counter 100 could be increased accordingly). At the beginning of this sequence of loading the cap counter into the last eight bits of shift register 45, first the entire shift register is cleared, and this is caused to happen by the state machine during state 111. Then the state machine represented by FIG. 11 causes the prompter 16 to go through a transmit cycle somewhat similar to the previously described transmission of data in the shift register 45 back to the programming station 5 for verification, only now the newly loaded contents (from cap counter 100) of the last eight bits of shift register 45 are transmitted to the programming station 5 and in an entirely similar manner, so that the programming station 5 can determine how many times the cap 4 was removed from the medication container 3.

Ordinarily, this procedure would take place when a prescription is being renewed, so that the contents of the shift register previously programmed therein are no longer meaningful.

Since the complete implementation of the modified version of the prompter circuitry has been disclosed in FIGS. 13A–13D, it would be redundant to redescribe the circuitry in detail, since the drawings show precisely how the circuit is connected and the timing diagram of FIG. 12 discloses to one skilled in the art precisely how it operates by indicating the waveforms of the identified nodes.

The flip-flop in FIG. 13B designated by reference numeral 127 is the one set in state 100 of state diagram of FIG. 11. The flip-flop designated by reference numeral 128 in FIG. 13B is the transmit flip-flop.

The output of the load flip-flop 127 is decoded to generate the $\overline{\text{RSTCTR}}$ signal on conductor 114 and the output of the transmit flip-flop 128 is decoded to generate the signal that loads the cap counter in the last eight bits of shift register 45.

The first bit of data received from the programming station 5 is interpreted by the prompter circuitry 3 to determine if the programming station 5 is to send a new string of 48 bits to the prompter or, in which case, the first bit transmitted to the prompter is a "one", or if the programming station 5 wants to read the contents of the cap counter 100, in which case the first bit of data sent by programming station 5 to prompter 3 is a "zero".

The top waveform in FIG. 12 represents the counting of the "gate counter" in FIG. 13B, consisting of the three D-type flip-flops 129.

While the invention has been described with reference to particular embodiments thereof, those skilled in the art will be able to substitute various parts and steps which are equivalent to those disclosed without departing from the true spirit and scope of the invention. For example, the reset switch 18 could be placed inside the cap 4 so that a reset signal is generated every time the cap 4 is removed.

In this version of the invention, wherein the reset signal is generated in response to removal of the cap 4 from the medication container 3, the "removal" signal could be interpreted to stop the audible beeping, but the blinking light emitting diode could continue until the cap is replaced. Provision of a reset switch that is automatically responsive to removal (or replacement) of the cap 4 of the container 3 is a useful technique that would be suitable as a "transparent" means for monitoring, by the pharmacist or physician, of the amount of the medication that a patient probably takes, since it is desirable in some instances that an amount of medication actually taken be monitored. When the monitoring technique is transparent to the patient, he is not likely to try to "fool" it by taking too many pills from the container at a particular prompting time to avoid waiting until the next prompting time to take the next scheduled pill.

We claim:

1. An automatic medication prompting method comprising the steps of:
   (a) coupling a data conductor of a portable prompting apparatus to a data conductor of a data inputting apparatus;
   (b) entering information representative of medication instructions into said data inputting apparatus;
   (c) converting said entered information into first digital data representative of times at or during which medication should be administered;
   (d) converting said first digital data into second digital data having a format suitable for transmission to said portable prompting apparatus in order to effectuate programming of said portable prompting apparatus by said inputting apparatus;
   (e) transmitting said second digital data to a first memory in said prompting apparatus and storing said second digital data in said first memory;
   (f) decoupling said prompting apparatus from said inputting apparatus;
   (g) continually periodically advancing a timekeeping circuit in said prompting apparatus;
   (h) accessing said first memory in response to said timekeeping circuit each time a predetermined interval elapses to obtain stored prompting data indicative of whether a prescription should be administered at that time;
   (i) generating an electrical prompting signal each time said obtained stored prompting data has a first value; and
   (j) producing an audible and/or a visual prompting signal in response to said electrical prompting signal.

2. The method of claim 1 including producing a signal that stops said audible and/or visual prompting signal.

3. The method of claim 2 wherein said format is a serial format and said data conductor is a data/clock conductor, said method including transmitting said second digital data and a clock signal both on said data/clock conductor.

4. The method of claim 3 wherein said first memory includes a shift register, said converting of said first digital data into said second digital data including generating a plurality of sequential bits each corresponding to a plurality of times each a predetermined interval of time later than the previous one of said times and each having a first logic level if a dose of medication should be administered then that bit otherwise having a second logic level.

5. The method of claim 4 including clocking said shift register in response to edges of the clock signal on said data/clock conductor and also actuating a first counter in response to edges of the clock signal and decoding said first counter to generate a data window in which said prompting device accepts data including said sequential bits produced on said data/clock conductor and conducting those bits to an input of said shift register.

6. The method of claim 3 including applying said clock signal to said timekeeping circuit to offset the amount of time until said timekeeping circuit causes said accessing of said first memory circuit by an amount of time equal to the difference between the present time of day and the time at which said prescription is supposed to be first administered.

7. The method of claim 1 including performing step (a) between steps (d) and (e).

8. The method of claim 6 wherein said entering of information into said data inputting apparatus is performed by means of a computer coupled to said inputting apparatus.

9. The method of claim 8 including operating on said entered information by means of a microprocessor to generate said clock signal and said second data embedded in said clock signal on a single output port connected to said data/clock line.

10. The method of claim 8 including re-transmitting said second data to said inputting device by means of said data/clock conductor and comparing said re-transmitted data to a stored table in said inputting device to verify the accuracy of the data received by said shift register.

11. The method of claim 1 including incorporating said prompting device in a locking cap of a medication container, and unlocking said cap in response to said electrical prompting signal.

12. The method of claim 11 including unlocking a ratcheting mechanism attached to said cap and having a pawl that engages teeth disposed in fixed relation to said medication container.

13. The method of claim 11 including automatically terminating said electrical prompting signal in response either to removing said cap from said medication container or replacing said cap on said medication container.

14. The method of claim 1 including generating a reset signal in response to a physical act which is associated with dispensing said medication and operating on said reset signal to terminate said electrical prompting signal.

15. The method of claim 14 including generating and storing information in a second memory in said prompting device representative of the number of times said reset signal has been produced since step (d) and later reading that information out of said second memory to determine the level of compliance with said medication instructions.

16. The method of claim 1 including the step of storing medical history information of a patient in a second memory of said prompting device before step (f).

17. The method of claim 1 wherein said visual prompting signal is produced by a liquid crystal display to indicate the type of medication to be administered and the time at which that medication should be administered.

18. The method of claim 15 wherein said later reading is performed by outputing said stored information representative of times said reset signal has been produced on said data conductor of said portable prompting device.

19. An automatic medication prompting system comprising in combination:

(a) a data inputting device for receiving a medication instruction information, said data inputting device having a first data conductor;

(b) a portable prompting device, said prompting device having a second data conductor;

(c) coupling means for coupling said data conductor of said portable prompting device to said data conductor of a data inputting apparatus;

(d) means for entering said information into said data inputting device;

(e) first means for converting said entered information into first digital data representative of the times at which a medication should be administered;

(f) second means for converting said first digital data into second digital data having a format suitable for transmission to said prompting device in order to effectuate programming of said portable prompting device by said data inputting device;

(g) means for transmitting said second digital data to a first memory in said prompting device and storing said second digital data in said first memory;

(h) a timekeeping circuit in said prompting device and means for periodically advancing said timekeeping circuit after decoupling said prompting device from said inputting device;

(i) means for accessing said first memory in response to said timekeeping circuit each time a predetermined interval elapses to obtain stored prompting data indicative of whether medication should be administered at that time;

(j) means for generating an electrical prompting signal each time said obtained stored prompting data has a first value; and (k) means for producing an audible and/or a visual prompting signal in response to said electrical prompting signal.

20. The automatic medication prompting system of claim 19 including circuit means producing a signal that stops said audible prompting signal a predetermined amount of time after said audible prompting signal begins.

21. The automatic medication prompting system of claim 19 wherein said format is a serial format and said first data conductor is a data/clock conductor, and said second data conductor is a data/clock conductor, data inputting device including circuit means for transmitting said second digital data and a clock signal both via said first data/clock conductor to said second data/-clock conductor.

22. The automatic medication prompting system of claim 21 wherein said first memory includes a shift register, said second converting means generating a plurality of sequential bits each corresponding to a plurality of times each a predetermined interval of time later than the previous one of said times and each having a first logic level if a dose of medication should be administered then that bit otherwise having a second logic level.

23. The automatic medication prompting system of claim 22 wherein said second converting means includes microprocessor means programmed to convert parallel-formatted data to serial-formatted data.

24. The automatic medication prompting system of claim 22 including circuit means for clocking said shift register in response to edges of said clock signal on said data/clock conductor and circuit means for actuating a first counter in response to edges of the clock signal and decoding said first counter to generate a data window in which said prompting device accepts data including said sequential bits produced on said data/clock conductor, and means for conducting those bits to an input of said shift register.

25. The automatic medication prompting system of claim 19 including means for applying said clock signal to said timekeeping circuit to offset the amount of time until said timekeeping circuit causes said accessing of said first memory circuit by an amount of time equal to the difference between the present time of day and the time at which said prescription is supposed to be first administered.

26. The automatic medication prompting system of claim 23 wherein said means for entering of information into said data inputting device includes a computer coupled to said inputting device.

27. The automatic medication prompting system of claim 26 wherein said microprocessor means operates on said entered information to generate said clock signal and generates said second data so that it is embedded in said clock signal on a single output port connected to said data/clock line.

28. The automatic medication prompting system of claim 19 wherein said prompting device includes circuit means for re-transmitting said second data from said first memory to said data inputting device via said second data/clock conductor and wherein said data inputting device includes means for comparing said re-transmitted second data to data stored in said inputting device to verify the accuracy of the second data earlier received by said shift register.

29. The automatic medication prompting system of claim 19 wherein said prompting device is included in a locking cap of a medication container, said prompting device including means for unlocking said cap in response to said electrical prompting signal.

30. The automatic medication prompting system of claim 29 wherein said unlocking means includes a ratcheting mechanism attached in fixed relation to said cap and having a pawl that engages teeth that are disposed in fixed relation to said medication container.

31. The automatic medication prompting system of claim 29 including circuit means for automatically terminating said electrical prompting signal in response either to removing said cap from said medication container orreplacing said cap on said medication container.

32. The automatic medication prompting system of claim 19 including means for generating a reset signal in response to a physical act which is associated with dispensing said medication and circuit means for operating in response to said reset signal to terminate said electrical prompting signal.

33. The automatic medication prompting system of claim 32 including means for effectuating storing of information in a second memory in said prompting device representative of the number of times said reset signal has been produced and means for later reading that information out of said second memory to determine a level of compliance with said medication instructions.

34. The automatic medication prompting system of claim 19 including means for storing medical history information of a patient in a second memory of said prompting device.

35. The automatic medication prompting system of claim 19 wherein said visual prompting signal includes a liquid crystal display to indicate the type of medication to be administered and the time at which that medication should be administered.

* * * * *